US009260861B2

(12) United States Patent
Babikian

(10) Patent No.: US 9,260,861 B2
(45) Date of Patent: Feb. 16, 2016

(54) PARTITION SYSTEMS AND METHODS OF INSTALLING THE SAME

(71) Applicant: BOBRICK WASHROOM EQUIPMENT, INC., North Hollywood, CA (US)

(72) Inventor: Dikran Babikian, Glendale, CA (US)

(73) Assignee: Bobrick Washroom Equipment, Inc., North Hollywood, CA (US)

( * ) Notice: Subject to any disclaimer, the term of this patent is extended or adjusted under 35 U.S.C. 154(b) by 0 days.

(21) Appl. No.: 14/209,775

(22) Filed: Mar. 13, 2014

(65) Prior Publication Data

US 2014/0283469 A1 Sep. 25, 2014

Related U.S. Application Data

(60) Provisional application No. 61/802,016, filed on Mar. 15, 2013.

(51) Int. Cl.

| | |
|---|---|
| ***E04H 1/12*** | (2006.01) |
| ***E04B 2/82*** | (2006.01) |
| ***E06B 7/16*** | (2006.01) |
| ***E06B 7/21*** | (2006.01) |
| ***E06B 7/36*** | (2006.01) |
| ***E06B 7/20*** | (2006.01) |
| *E05D 11/00* | (2006.01) |
| *E04B 2/74* | (2006.01) |

(52) U.S. Cl.

CPC ..... *E04B 2/828* (2013.01); *E04H 1/1216* (2013.01); *E04H 1/1244* (2013.01); *E04H 1/1266* (2013.01); *E06B 7/16* (2013.01); *E06B 7/20* (2013.01); *E06B 7/21* (2013.01); *E06B 7/367* (2013.01); *E04B 2/7425* (2013.01); *E05D 11/0054* (2013.01); *E05D 2011/0072* (2013.01)

(58) Field of Classification Search

CPC ..... E04B 2/828; E04B 2/7405; E04B 7/16; E04B 7/21; E04B 7/367; E04H 1/1266; E05D 11/0054; E05D 2011/0072; E05Y 2800/41

See application file for complete search history.

(56) References Cited

U.S. PATENT DOCUMENTS

| | | | | |
|---|---|---|---|---|
| 1,667,534 | A * | 4/1928 | Carpenter et al. | 52/764 |
| 2,240,482 | A | 12/1938 | Anderson | |
| 2,557,716 | A * | 6/1951 | Allee | 16/250 |
| 4,845,892 | A * | 7/1989 | Pinto | 49/383 |
| 4,881,353 | A * | 11/1989 | Braendel et al. | 52/239 |

(Continued)

FOREIGN PATENT DOCUMENTS

| | | |
|---|---|---|
| DE | 195 01 033 A1 | 7/1996 |
| DE | 195 26 618 A1 | 1/1997 |

(Continued)

OTHER PUBLICATIONS

PCT Search Report and Written Opinion for International Application PCT/US2014/026478, mailed Dec. 3, 2014; 12 pages.

(Continued)

*Primary Examiner* — Adriana Figueroa

(74) *Attorney, Agent, or Firm* — Christie, Parker & Hale, LLP

(57) ABSTRACT

A partition system includes a door adjacent a stile defining a seam there-between and a member extending across the seam for blocking viewing through the seam. Methods of installing partitions systems are also provided.

22 Claims, 21 Drawing Sheets

(56) References Cited

U.S. PATENT DOCUMENTS

| | | | | |
|---|---|---|---|---|
| 5,437,065 | A * | 8/1995 | Sakawa | 4/342 |
| 5,592,787 | A * | 1/1997 | Ophardt | 52/34 |
| 5,630,302 | A * | 5/1997 | Rosenband | 52/239 |
| 7,024,823 | B2 * | 4/2006 | Keller | 49/399 |
| 7,987,635 | B2 * | 8/2011 | Thielke et al. | 52/32 |
| 8,627,610 | B1 * | 1/2014 | Crowther | 52/32 |
| 2003/0205001 | A1 * | 11/2003 | Williams et al. | 49/383 |
| 2007/0151164 | A1 * | 7/2007 | Marshall | 49/397 |
| 2008/0263962 | A1 * | 10/2008 | Wei | 49/462 |
| 2009/0007504 | A1 | 1/2009 | Thielke et al. | |
| 2012/0175065 | A1 * | 7/2012 | Mayzum | 160/24 |

FOREIGN PATENT DOCUMENTS

| | | | | |
|---|---|---|---|---|
| DE | 199 18 099 | A1 | 10/2000 | |
| DE | 203 08 167 | U1 | 9/2004 | |
| DE | 102008048695 | A1 * | 3/2010 | E04H 1/12 |
| DE | 20 2011 005 266 | U1 | 7/2011 | |
| EP | 0 893 556 | A1 | 1/1999 | |
| GB | 2 445 031 | A | 6/2008 | |

OTHER PUBLICATIONS

Thrislington Cubicles; *Advanced Design in Fitting Room Systems*; Brochure; Printed Apr. 1991; Pacoima, CA; 4 Pages.

* cited by examiner

PARTITION SYSTEMS AND METHODS OF INSTALLING THE SAME

CROSS-REFERENCE TO RELATED APPLICATION

This application claims priority to and the benefit of Provisional Application No. 61/802,016, filed on Mar. 15, 2013, the entire disclosure of which is incorporated herein by reference.

BACKGROUND

The present disclosure relates to partitions and partition systems for use in restrooms such as in public restrooms, and to methods of installing the same. Individual stalls, for example in public area restrooms, showers, changing stalls, or any variety of other such rooms requiring compartments or stalls, are typically found in schools, airports, movie theaters, stadiums, recreation parks, etc. These individual stalls are generally provided by subdividing walls in the form of separate vertical partitions installed after the room has been finished. In order to provide adequate stability and support, these partitions are attached to a vertical support member, often a stile or pilaster. When one end of a partition is mounted on a traditional wall, the other end of the partition generally terminates at the stile or pilaster. These partitions may be attached by brackets or other devices to a stile or pilaster in a plane perpendicular to the stile or pilaster. Stiles and pilasters may be used to frame doors in these stalls, wherein the door is mounted in line with and between two stiles or pilasters. The stiles or pilasters, themselves, generally may be anchored to the floor, hung from the ceiling, or both.

Typical partition system assembly requires attachment of the partition walls to vertical support members, including traditional walls, stiles, or pilasters, that are, themselves vertically connected to the floor and/or ceiling of the room where the partition system is being installed. Thus, where the walls, floor, and/or ceiling of the room are not perfectly level, as is often the case even within typical allowable construction tolerances, the alignment of the partition system is inevitably affected. As a result, the various members of the partition system, including the partition walls, vertical support members, and/or doors, may be misaligned. This misalignment may result in the formation of excessive openings or gaps providing a line of sight at the seams between adjacent partition panels or at the door hinges or seams, improper door closure or function at the door frames, unsightly aesthetics, and increases in the costs and timing of construction for installation of the partition panels as the panels may need to be specially made to non-standard dimensions to account for the room imperfections. Consequently, installation of such partition systems can be time consuming and expensive.

SUMMARY

A partition system is provided and includes a first stile, second stile spaced apart from the first stile, and a door rotatably coupled to the first stile such that the door is rotatable between the first and second stiles and can rotate between a closed position where a first end of the door is adjacent the first stile defining a first seam there-between and a second end of the door opposite the first end is adjacent the second stile defining a second seam there-between, and an open position where the second end of the door is swung away from the second stile. The partition system also includes a first member extending across the first seam when the door is in the closed position to block viewing through the seam. In an example embodiment, the first member is mounted to one of the door and the first stile. In a further example embodiment, the first member is received in a recess formed in the other of the door and the first stile when the door is in the closed position and is withdrawn from the recess when the door is in the open position. In one example embodiment, the recess is a channel. In a further example embodiment, the channel is formed on an end of one of the door and the first stile and the system further includes a channel shaped member complementary to the channel which is fitted into the channel such that the first member is received in the channel shaped member. In a further example embodiment, the first member is a first flange of an angle which first flange extends transversely from a second flange of the angle. In yet another example embodiment, the system also includes a second member extending across the second seam when the door is in the closed position. In another example embodiment, the second member is mounted to one of the door and the second stile.

In a further example embodiment a method of installing a partition system is provided. The method includes coupling a first stile bracket vertically to a first side wall, and coupling a first stile having a first end opposite a second end to the first stile bracket with the second end distal from the stile bracket such that the second end is vertically plumb. The method also includes coupling a first panel bracket vertically to a rear wall, the rear wall extending transversely from the first side wall, coupling a first side panel having a first end opposite a second end to the first panel bracket such that the second end is distal from the first panel bracket such that the first side panel second end is vertically plumb. The method further includes coupling a second stile to the first side panel such that the first side panel extends from the second stile to the first panel bracket, and rotatably coupling a first door including a first end opposite a second end to the first stile such that the door is rotatable between the first and second stiles between a closed position where the first end of the door is adjacent the first stile defining a first seam there-between and the second end of the door is adjacent the second stile defining a second seam there-between, and an open position where the second end of the door is swung away from the second stile. In another example embodiment, the method also includes coupling a second panel bracket vertically to a rear wall spaced apart from the first panel bracket, coupling a second side panel having a first end opposite a second end to the second panel bracket such that the second end of the second side panel is distal from the second panel bracket and such that the second side panel second end is vertically plumb, coupling a third stile to the second side panel such that the second side panel extends from the third stile to the second panel bracket, and rotatably coupling a second door including a first end opposite a second end to the second stile such that the second door is rotatable between the second and third stiles between a closed position where the first end of the second door is adjacent the second stile defining a third seam there-between and the second end of the second door is adjacent the third stile defining a fourth seam there-between, and an open position where the second end of the second door is swung away from the third stile. In yet another example embodiment, the method further includes coupling a head rail to the first and second side panels. In another example embodiment, coupling the first stile to the first stile bracket includes coupling the first stile to the first stile bracket with the first end of the first stile extending at an angle relative to the first side wall along a plane of the first stile extending through the entire first stile. In yet another example embodiment, coupling the first side panel to the first side panel bracket includes coupling the first side panel to the first side panel bracket with the first end of the first side panel extending at an angle relative to the rear wall along a plane of the first side panel extending through the entire first side panel. In one example embodiment, coupling the second side panel to the second side panel bracket includes coupling the second side panel to the second side panel bracket with the first end of the second side panel extending at an angle relative to the rear wall along a plane of the second side panel extending through the entire second side panel. In yet another example embodiment the method includes coupling one or more second panel brackets vertically to a rear wall spaced apart from the first panel bracket and coupling one or more second side panels, each of the one or more side panels having a first end opposite a second end, to the one or more second panel brackets, such that each of the one or more side panels is coupled to a corresponding second panel bracket of the one or more second panel brackets, such that the second end of each of the one or more second side panels is distal from its corresponding second panel bracket and such that the each of the one or more second side panel second ends is vertically plumb. The embodiment may further include coupling one or more third stiles to the one or more second side panels such that the one or more second side panels extend from their corresponding third stile to their corresponding second panel bracket, and rotatably coupling at least one or more second doors including a first end opposite a second end to the one or more second stiles, wherein each of the one or more second doors is rotatable between its corresponding second and third stiles between a closed position where the first end of each of the one or more second door is adjacent its corresponding second stile defining a third seam there-between and the second end of each of the one or more second doors is adjacent its corresponding third stile defining a fourth seam there-between, and an open position where the second end of each of the one or more second doors is swung away from its corresponding third stile. In yet a further example embodiment, the method also includes coupling a second stile bracket to a second side wall spaced apart from the first side wall, wherein the rear wall extends between the first and second side walls, coupling a fourth stile having a first end opposite a second end to the second stile bracket with the first end of the fourth stile distal from the stile bracket and wherein the first end is vertically plumb. In one example embodiment, the method further includes rotatably coupling another door including a first end opposite a second end to a last stile of the one or more third stiles, such that the another door is rotatable between the last stile and fourth stile between a closed position where the first end of the another door is adjacent the last stile defining a seam there-between and the second end of the another door is adjacent the fourth stile defining a seam there-between, to an open position where the second end of the another door is swung away from the fourth stile. In yet another example embodiment, the first side of a second side panel of the one or more second side panels is at an angle relative to the rear wall along a plane of the second side panel extending through the entire second panel. In yet a further example embodiment, the method also includes coupling a head rail to the first and the one or more second side panels. In any embodiment, the method may also include mounting a pedestal to the floor and coupling a side panel to the pedestal.

Figure 1:
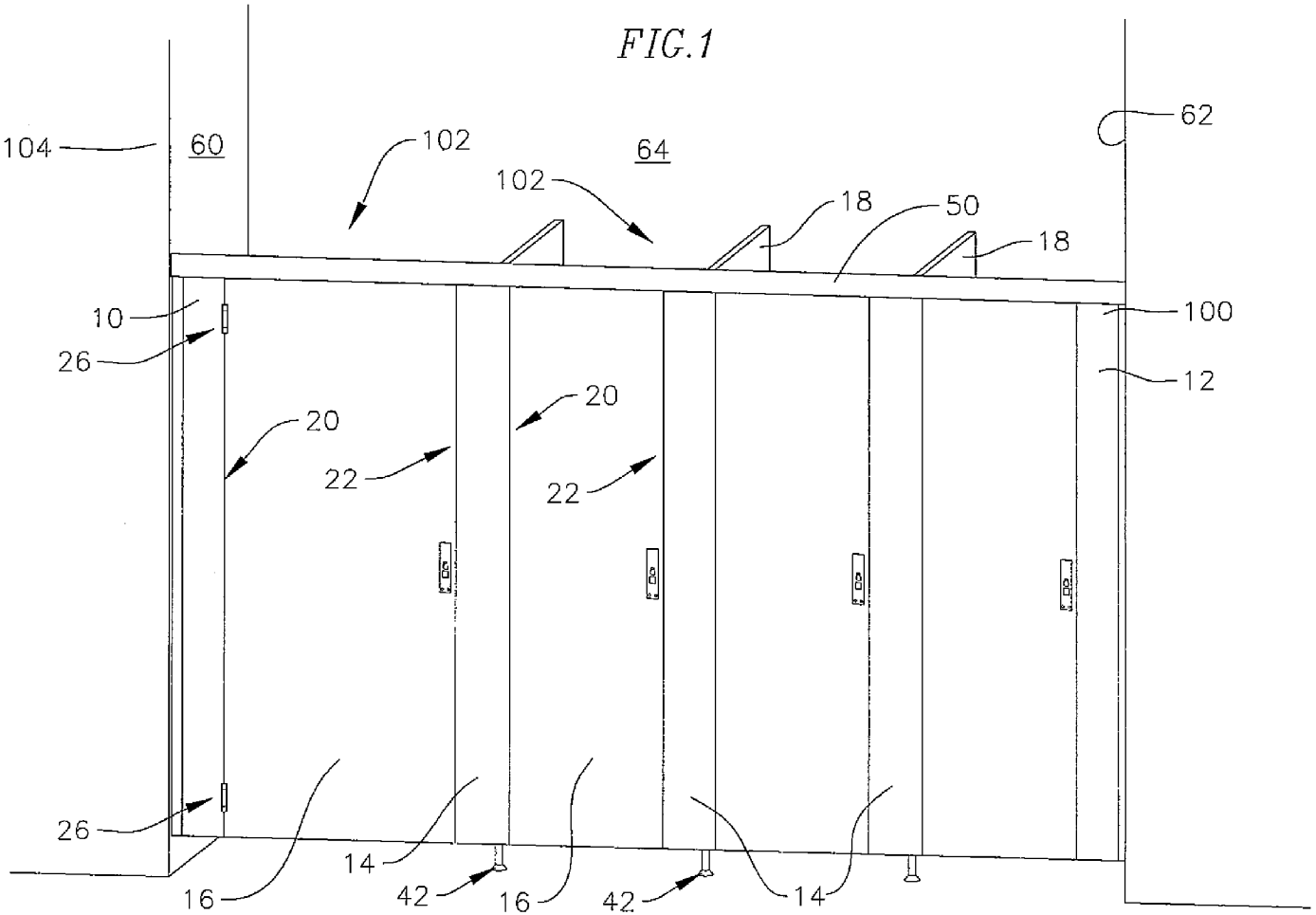
FIG. 1 is a perspective view of one embodiment of a partition system of the present disclosure including floor support and head rail features.

Before any embodiment of the disclosure is explained in detail, it is to be understood that the disclosure is not limited in its application to the details of construction and arrangement of components set forth in the following description, or illustrated in the drawings. The invention is capable of alternative embodiments and of being practiced or being carried out in various ways. For example, numerical dimensions or other specified numerical limitations, where they appear on the following drawings, represent those of exemplary embodiments only and may be modified by one skilled in the art as conditions warrant. Also, it is to be understood that that the terminology used herein is for the purpose for illustrative description and should not be regarded as limiting.

DETAILED DESCRIPTION

The present disclosure relates to partitions and partition systems for use in restrooms such as public restrooms, to partitions and partition systems having line-of-sight blocking in the seams or gaps between partition panels and to methods of installing the same.

Figure 10A:
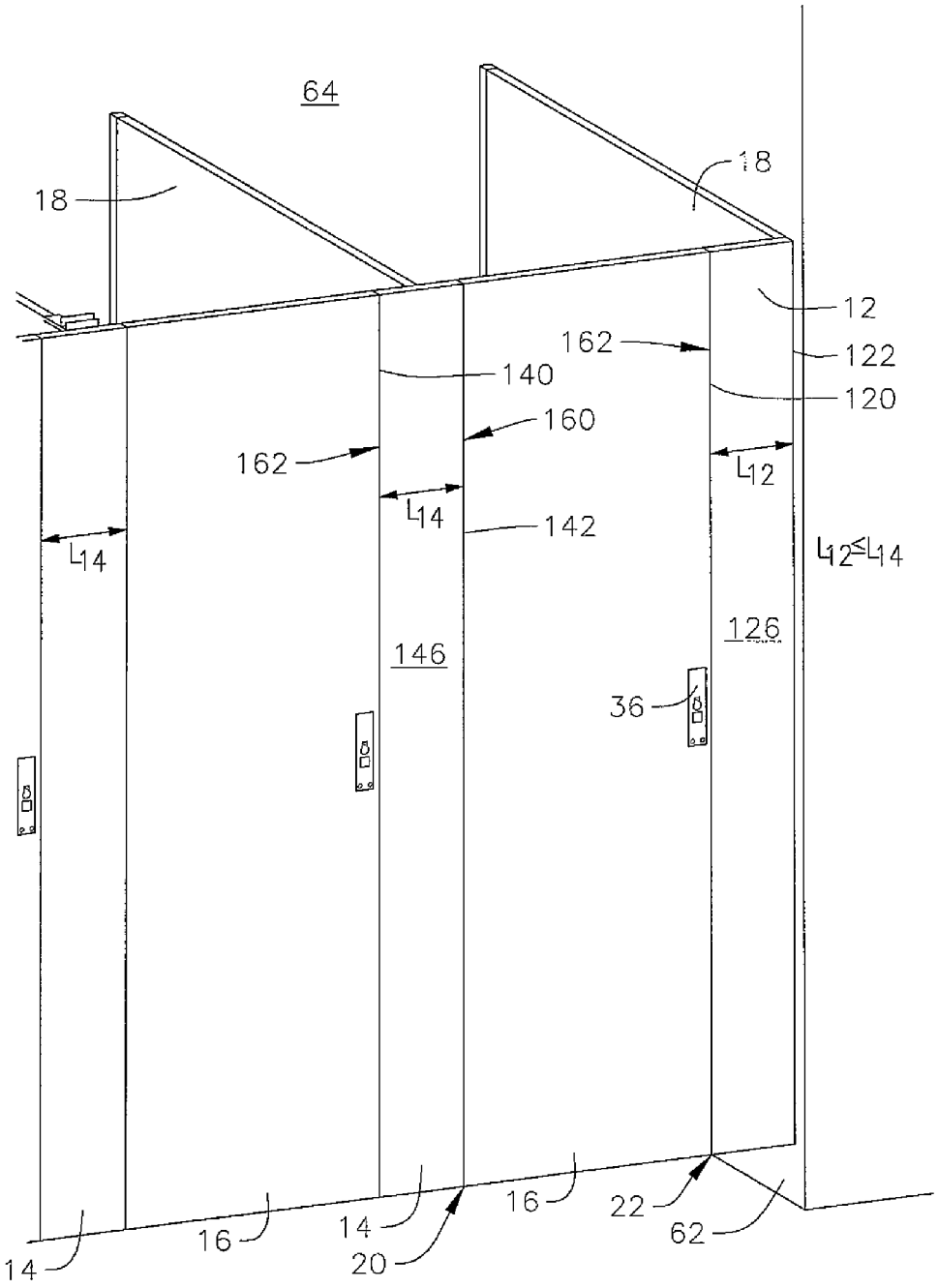
FIG. 10*a* is a perspective front elevation view of an embodiment illustrating the attachment of the second end stile to a side panel, where the partition system is not attached to a second side wall.
Figure 10B:
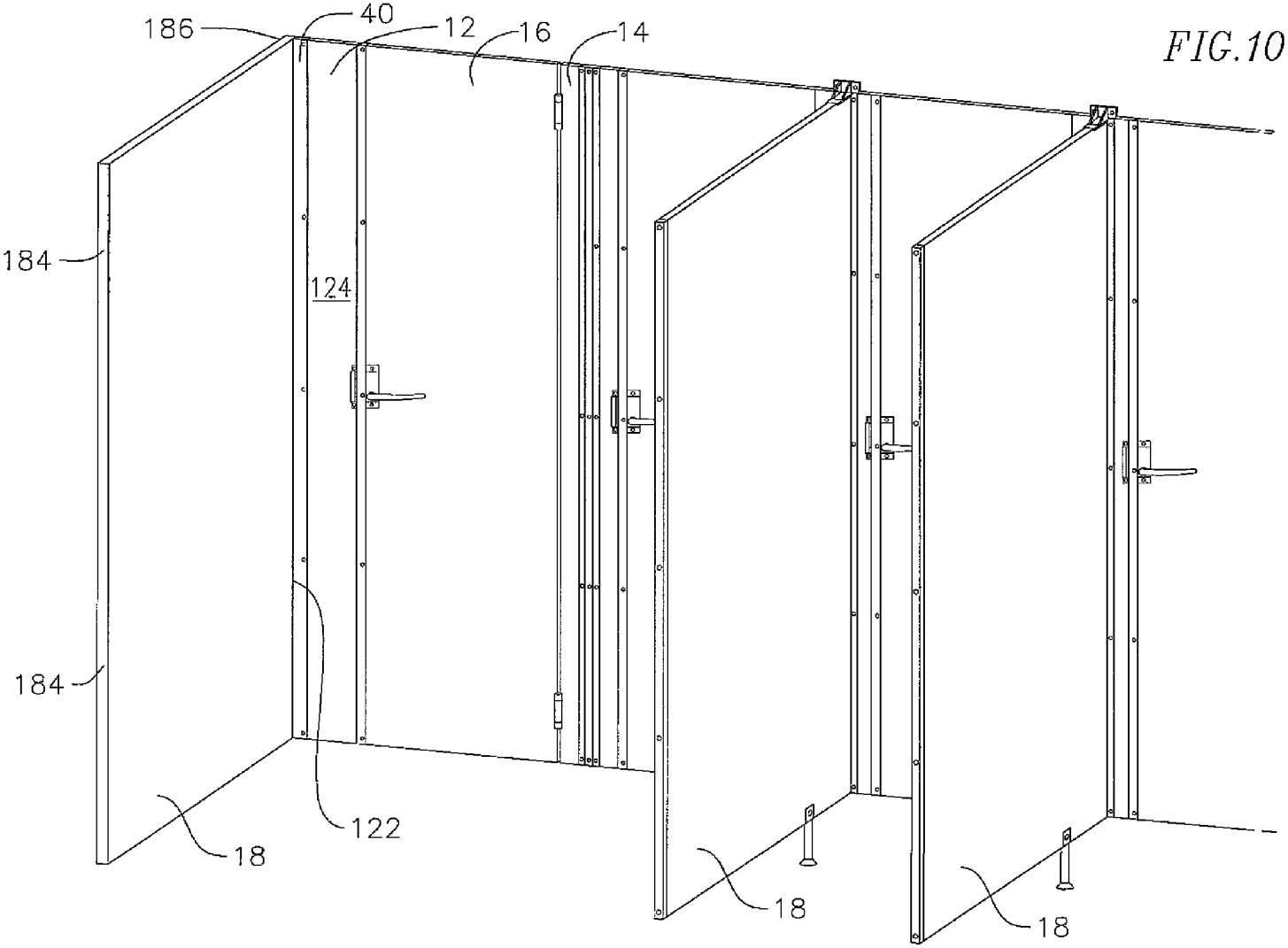
FIG. 10*b* is a perspective rear elevation view of the embodiment of FIG. 10*a* illustrating the attachment of the second end stile to the side panel.

FIG. 1 shows a perspective view of a partition system 100 according to an embodiment of the present disclosure installed in a room 104. The partition system 100 includes a plurality of stalls 102, where each stall 102 has a door 16, at least one side panel 18, separating adjacent stalls. Adjacent doors are separated from each other by a stile. The partition system 100 has one first end stile 10 connected to a first side wall 60 of the room, and one second end stile 12 connected to a second side wall 62 of the room. In other embodiments where the partition system 100 does not extend to a second side wall 62, the partition system may be connected to only the first side wall 60 at the first end stile 10, and may be connected to a side panel 18 at the second end stile 12, as shown in FIGS. 10*a* and 10*b*. The partition system 100 also includes at least one interior stile 14 in line with the first end stile 10 and the second end stile 12. The stiles 10, 12, 14 are lined up and plumbed along a vertical plane. Each stile 10, 12, 14 is spaced apart from its adjacent stile 10, 12, 14 to create the opening where each stall door 16 is located.

Figure 2A:
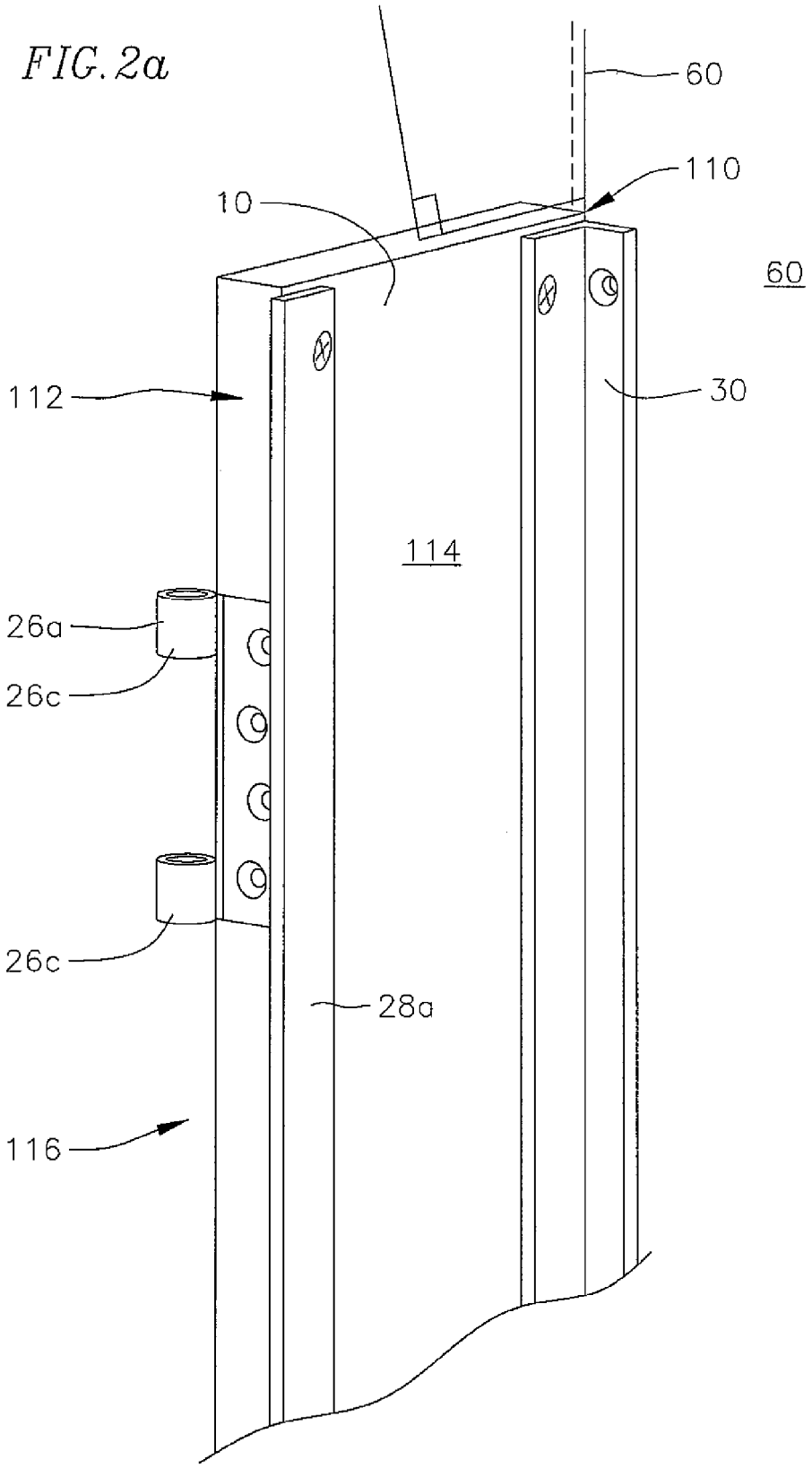
FIGS. 2*a* and 2*b* are a partial perspective elevation view and a plan view, respectively, of an embodiment illustrating the attachment of a first end stile to a first side wall via a first stile bracket, including illustrating the plumbed first end stile, even where the first side wall and first stile bracket are not perfectly plumb.
Figure 2B:
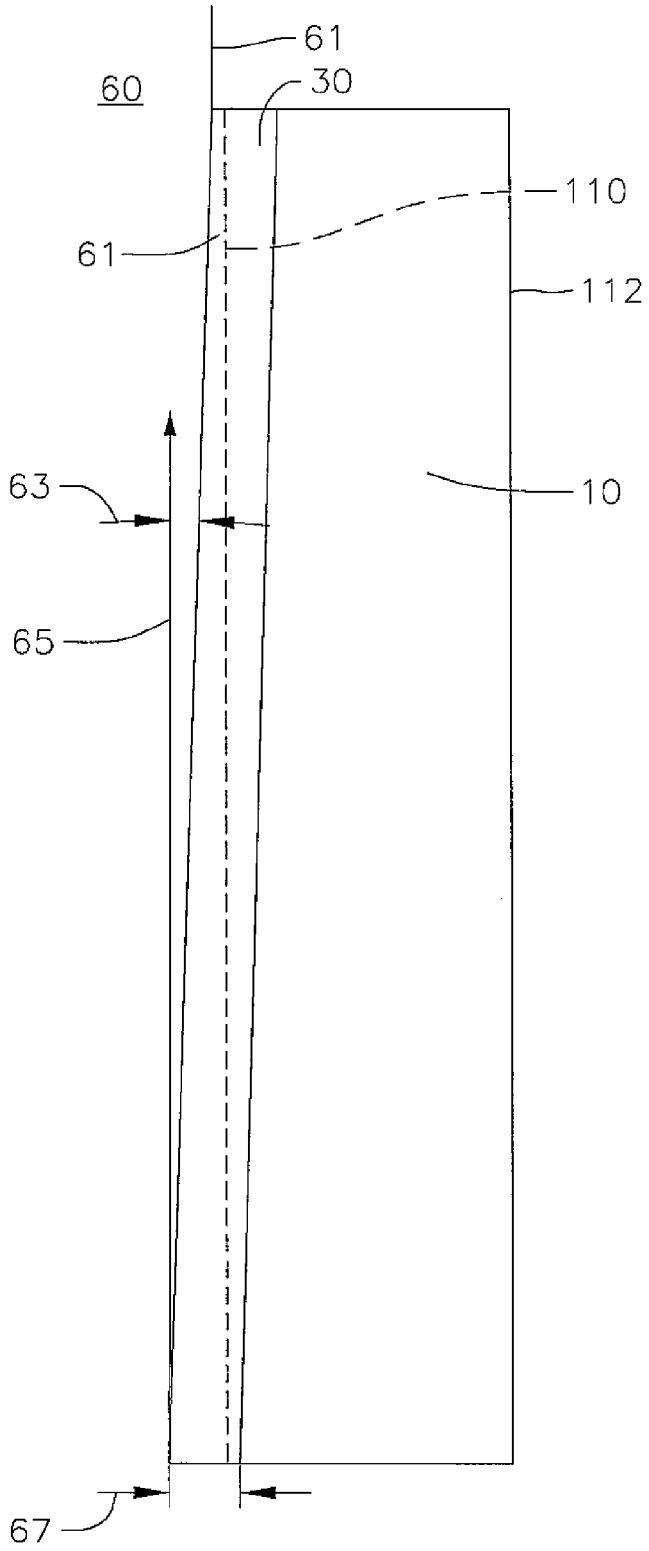

With reference now to FIGS. 1, 2*a* and 2*b*, in embodiments of the present disclosure, the first end stile 10 is connected to the first side wall 60 via a first stile bracket 30. In some embodiments, the first stile bracket 30 is an angle or a channel. The first stile bracket 30 is configured to be attached abutting the first side wall 60. Often, the walls, floors, and ceilings of a room will not be perfectly plumb or level as a result of various factors, for example construction related factors. For example the surface 61 of the wall 60 is offset by an angle 63 from a vertical plane 65. In embodiments of the present disclosure, the first stile bracket 30 is attached to the first side wall 60 such that the first stile bracket 30 extends vertically along the first side wall 60. In some embodiments, a first portion proximate first edge 110 of the first end stile 10 is attached to the first stile bracket 30 and adjusted such that a second edge 112 of the first end stile 10, opposite the first edge 110, is vertically plumb relative to a reference point. For example, the stile is attached, as for example by fasteners, to the first stile bracket at an angle (e.g., when the wall surface 61 extends at angle, such as an angle 63, such that it is not perfectly vertical) such that the second edge 112 is vertically plumb, i.e., it is parallel to vertical plane 65. When attached in this manner, the first end stile 10 second edge (which defines the opening for receiving the door) is perfectly plumb, even where the first side wall 60 and the first stile bracket 30 are not plumb relative to the vertical plane. In an example embodiment, the first stile bracket 30 should have sufficient width 67 along its entire length to allow the stile to be rotated with its first edge 110 completely overlapped by the width while the second edge is vertically plumb. In some embodiments where the first stile bracket 30 is an angle, the first end stile 10 is attached to the first stile bracket 30 at a portion on a rear surface 114 of the first end stile 10 proximate its first edge 110. In some embodiments, the first stile bracket 30 extends the entire length of the first end stile 10. In other embodiments, the first stile bracket 30 extends only along a portion of the length of the first end stile 10. In some embodiments, the first end stile 10 is fully structurally supported by the first stile bracket 30, such that the first end stile 10 is suspended, meaning it is not connected to the floor or ceiling of the room 104.

Figure 6A:
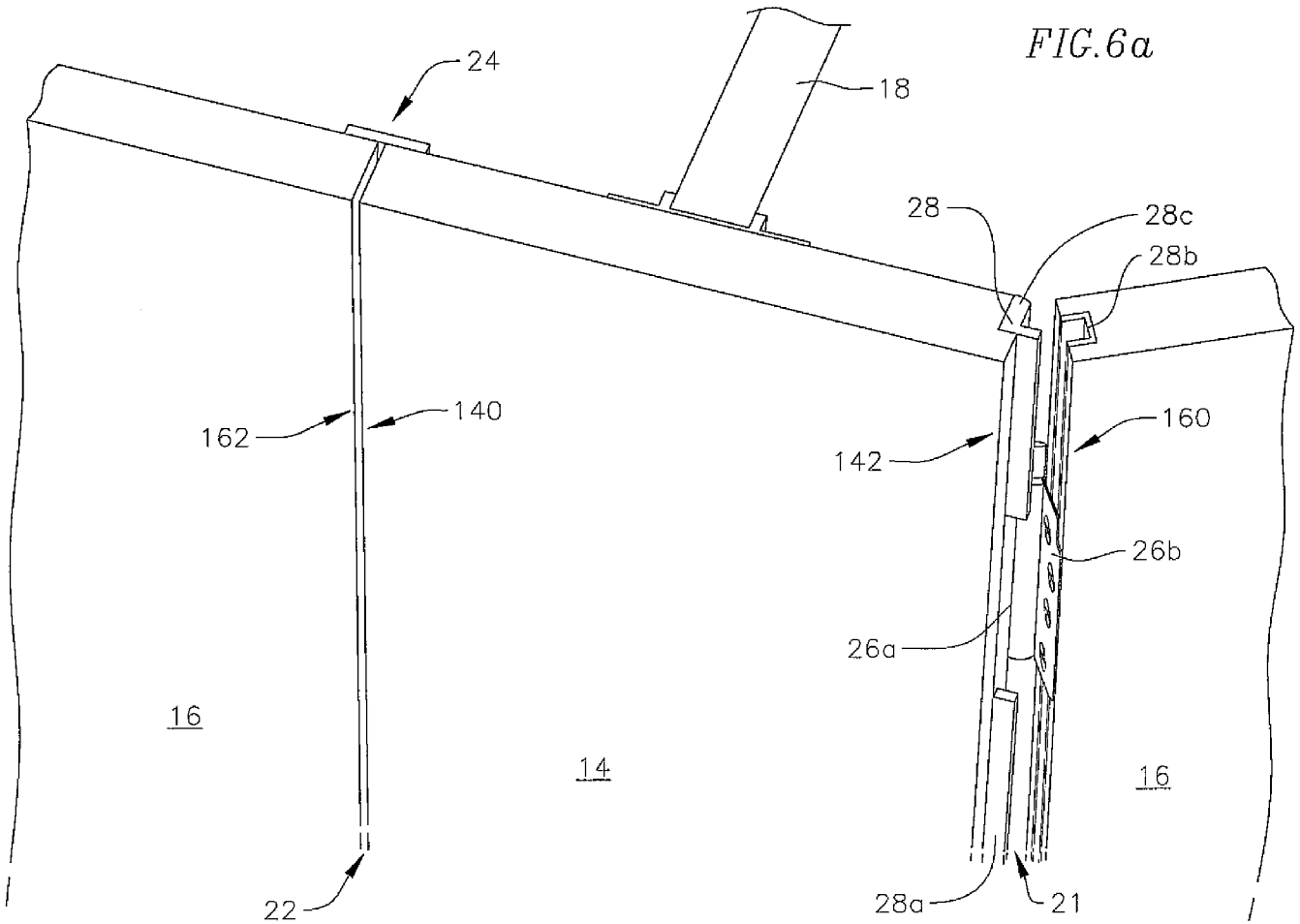
FIG. 6*a* is a partial perspective front elevation view of an embodiment of the present disclosure illustrating a door installed at a stile, when the door is in an open position.
Figure 6B:
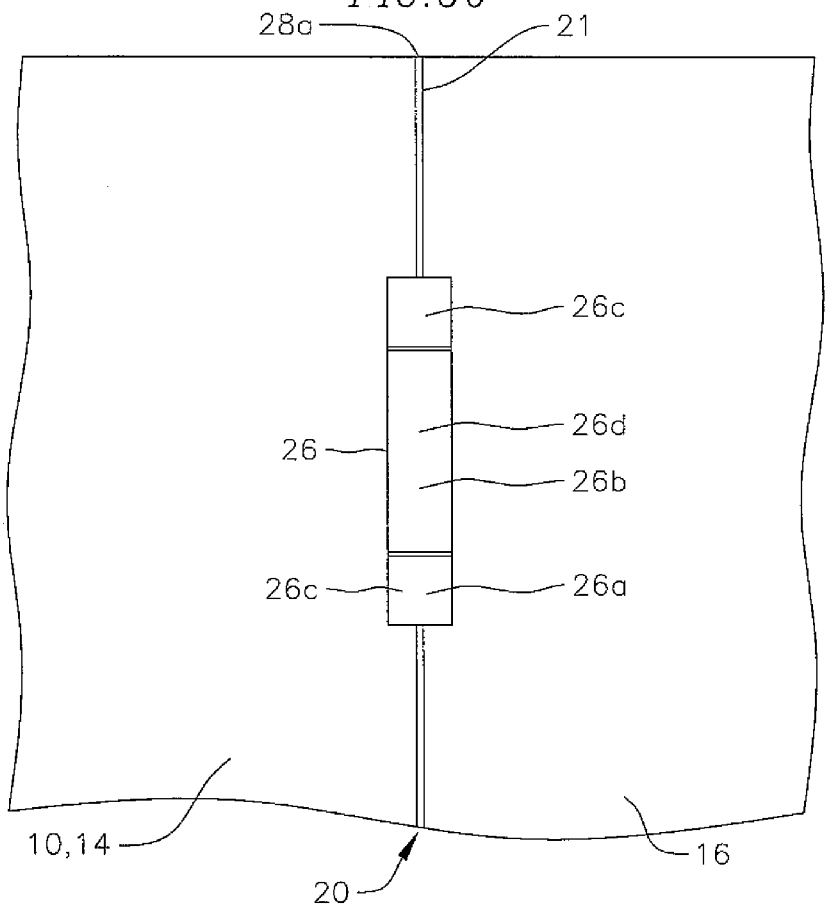
FIG. 6*b* is a partial perspective front elevation view of the embodiment of FIG. 6*a* with the door in a closed position, illustrating a line of sight eliminating first seam.

With continued reference to FIGS. 2, 6*a* and 6*b* in one embodiment, the first end stile 10 includes at least a portion of a hinge member 26 along or proximate a second edge 112 of the first end stile 10, defining a portion of a first seam 20. In one embodiment, the hinge member 26 includes two complementary hinge elements 26*a*, 26*b*. At first, hinge element 26*a* in an example embodiment includes at least two knuckles 26*c*. A second hinge element 26*b* including at least one knuckle 26*d*. Knuckle 26*d* is positioned between knuckles 26*c* and a hinge pin (not shown) penetrates the knuckles 26*c*, 26*d* for rotatably coupling the hinge elements 26*a*, 26*b* together, as for example shown in FIG. 6*b*. In other embodiments, the second hinge element 26*b* is attached at or proximate the second edge 112 and the first hinge element 26*a* is attached to the door 16. A first seam 20 is a defined by a gap between a door and its adjacent stile, as for example shown in FIG. 6*b*.

Figure 3A:
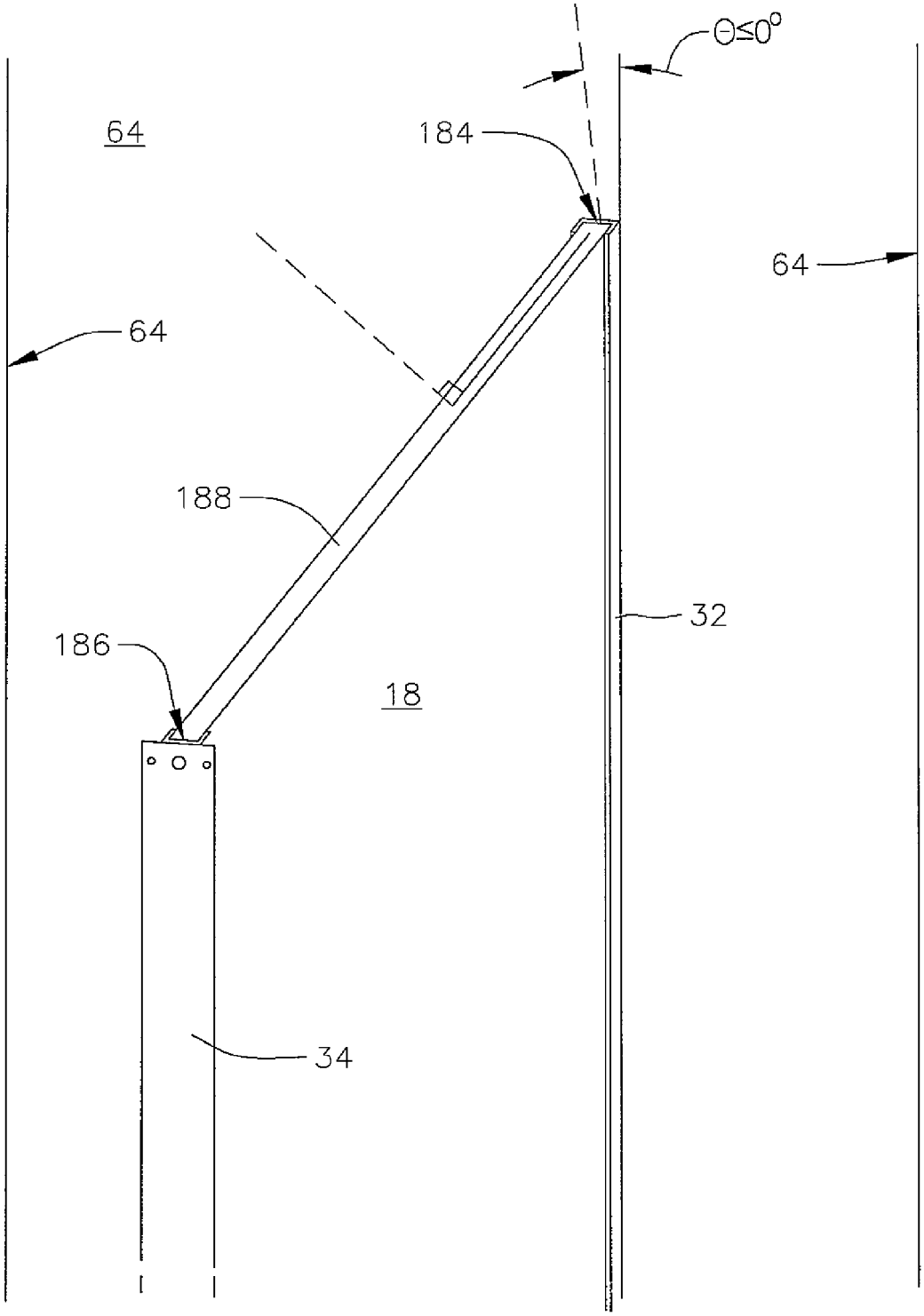
FIG. 3*a* is a partial perspective elevation view of an embodiment illustrating the attachment of a side panel to a rear wall via a panel bracket, including illustrating the plumbed side panel, even where the rear wall and panel bracket are not perfectly plumb.

With reference now to FIGS. 1 and 3*a*, in embodiments of the present disclosure, each side panel 18 is connected to the rear wall 64 via a panel bracket 32. In some embodiments, the panel bracket 32 is an angle or a channel. The panel bracket 32 is configured to be attached abutting the rear wall 64. It may be fastened or otherwise adhered to the rear wall 64. In embodiments of the present disclosure, the panel bracket 32 is attached to the rear wall 64 such that the panel bracket 32 extends vertically along the rear wall 64. In some embodiments, a first end 184 of the side panel 18 is coupled to the panel bracket 32 and adjusted such that a second end 186 of the side panel 18, opposite the first end 184, is vertically plumb relative to a reference point. The first end 184 of the side panel 18 is coupled to the panel bracket by fastening or otherwise adhering a portion of the side panel proximate the first end 184 to the panel bracket and/or by fastening or otherwise adhering the first end 184 to the panel bracket. When attached in this manner, each side panel 18 is perfectly plumb (i.e., each side panel second end 186 opposite the first end 184 is perfectly plumb), even where the rear wall 64 and the panel bracket 32 are not, relative to the vertical plane. In such case, the first end is at one angle relative to the rear wall and the panel bracket. As with the stile bracket, in an example embodiment, the panel bracket should have sufficient width along its entire length to overlap the first end 184 of the side panel, while the side panel second end is vertically plumb. In some embodiments where the panel bracket 32 is a channel, the side panel 18 is attached to the panel bracket 32 at a first end 184 of the side panel 18, as for example shown in FIG. 3*a*. In some embodiments, the panel bracket 32 extends the entire length of the side panel 18. In other embodiments, the panel bracket 32 extends only along a portion of the length of the side panel 18. In some embodiments, each side panel 18 is fully structurally supported by the panel bracket 32, such that each side panel 32 is suspended, meaning it is not connected to the floor or ceiling of the room 104. Each panel may be fastened with fasteners or otherwise adhered to its corresponding panel bracket.

Figure 7A:
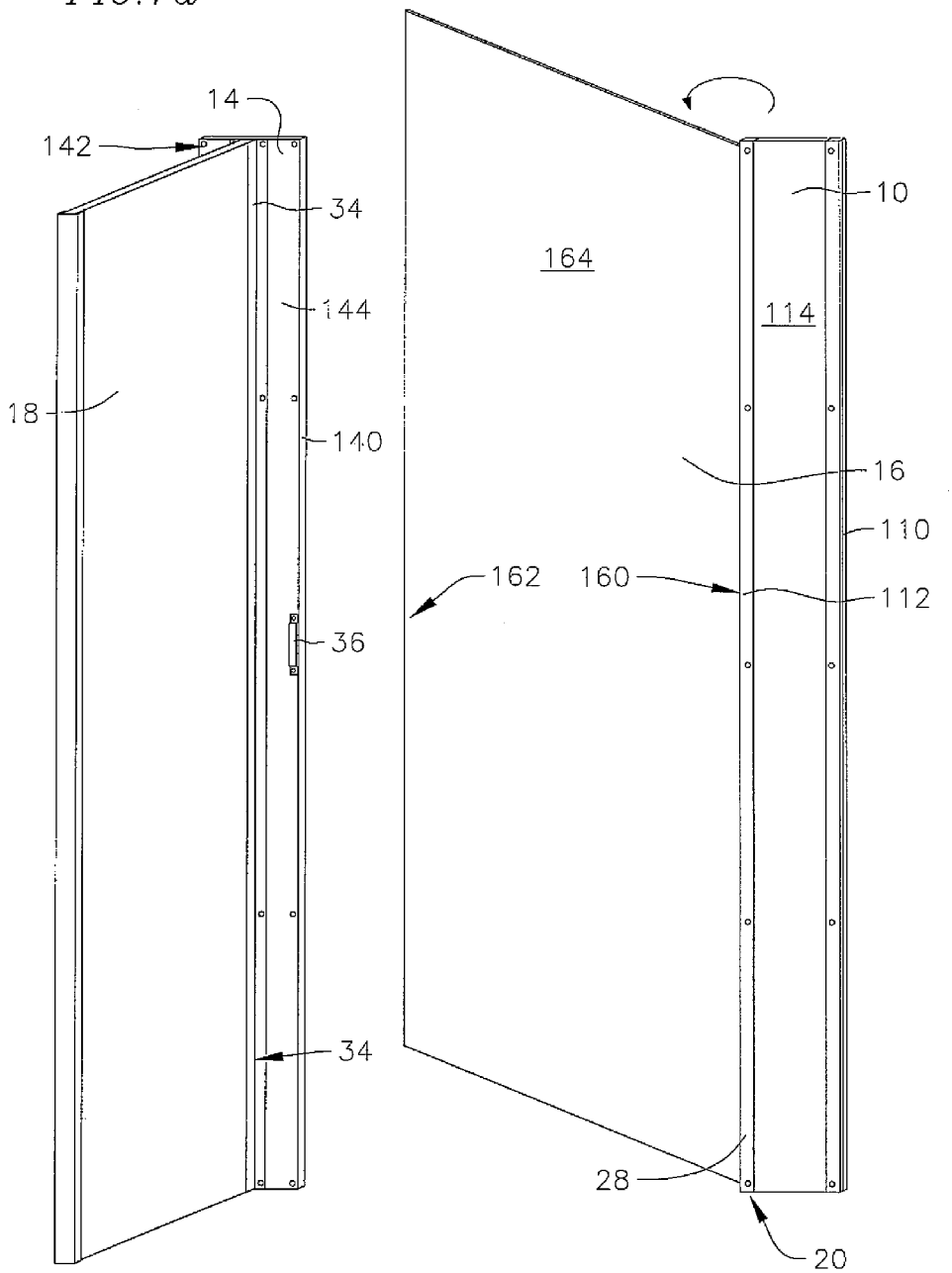
FIG. 7*a* is a partial perspective rear elevation view of the embodiment of FIG. 6*a*, further illustrating installation of a first interior stile adjacent to the door at a side panel, and showing the door in an open position.
Figure 7B:
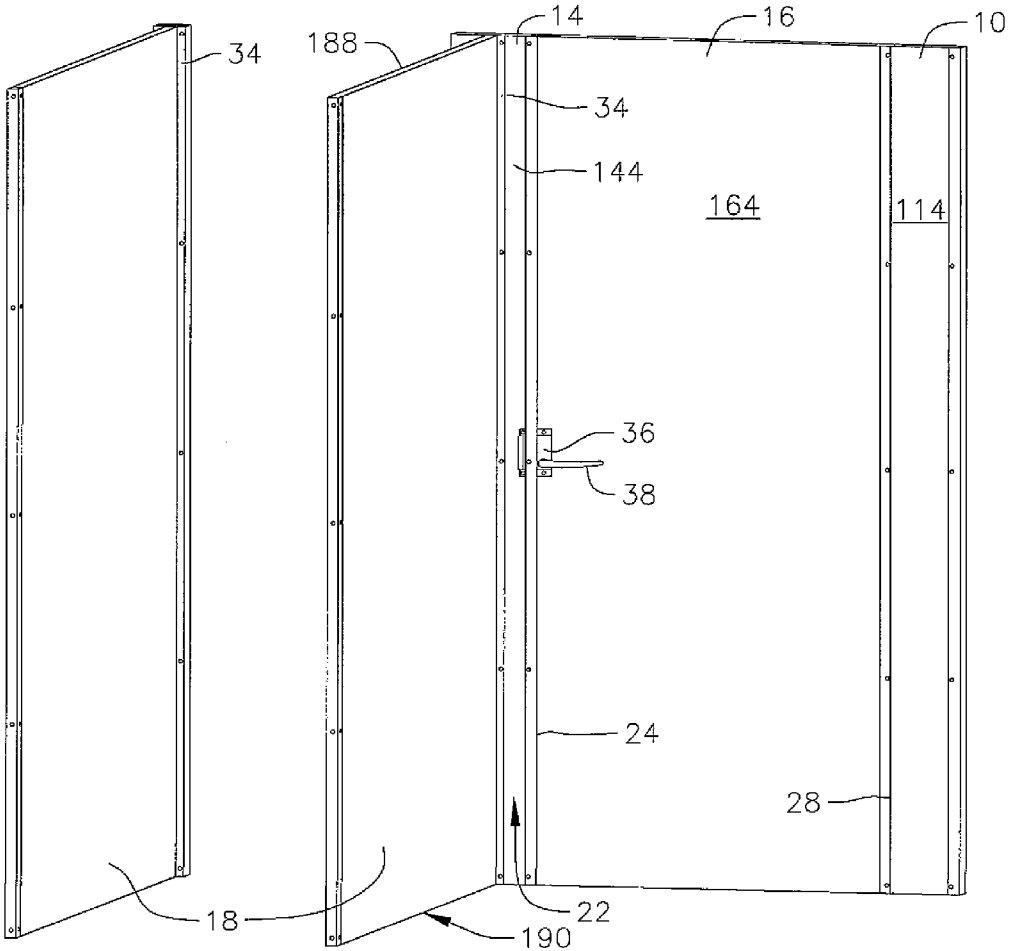
FIG. 7*b* is a partial perspective rear elevation view of the embodiment of FIG. 7*a*, showing the door in a closed position, including illustrating a line of sight eliminating feature.

With continued reference to FIG. 1, in one embodiment, the partition system 100 includes floor supports 42 at a bottom surface 190 (as shown in FIG. 7*b*) of each side panel 18, connecting the side panel 18 to the flooring surface of the room 104. In one embodiment, the floor support 42 has an adjustable height optimal for leveling the supported connecting side panel 18 to a desired height. In one embodiment, the floor supports 42 can be mounted to the flooring surface, for example through a screw system, silicone, or other adhesive or mounting mechanisms. The floor supports 42 can be any suitable material as will be appreciated by those skilled in the art. In one embodiment, the floor supports 42 can be aluminum, aluminum with nylon, stainless steel, or any combination thereof. In one embodiment the floor supports 42 are self-leveling floor mounted pedestals with grouted set pins.

Figure 4A:
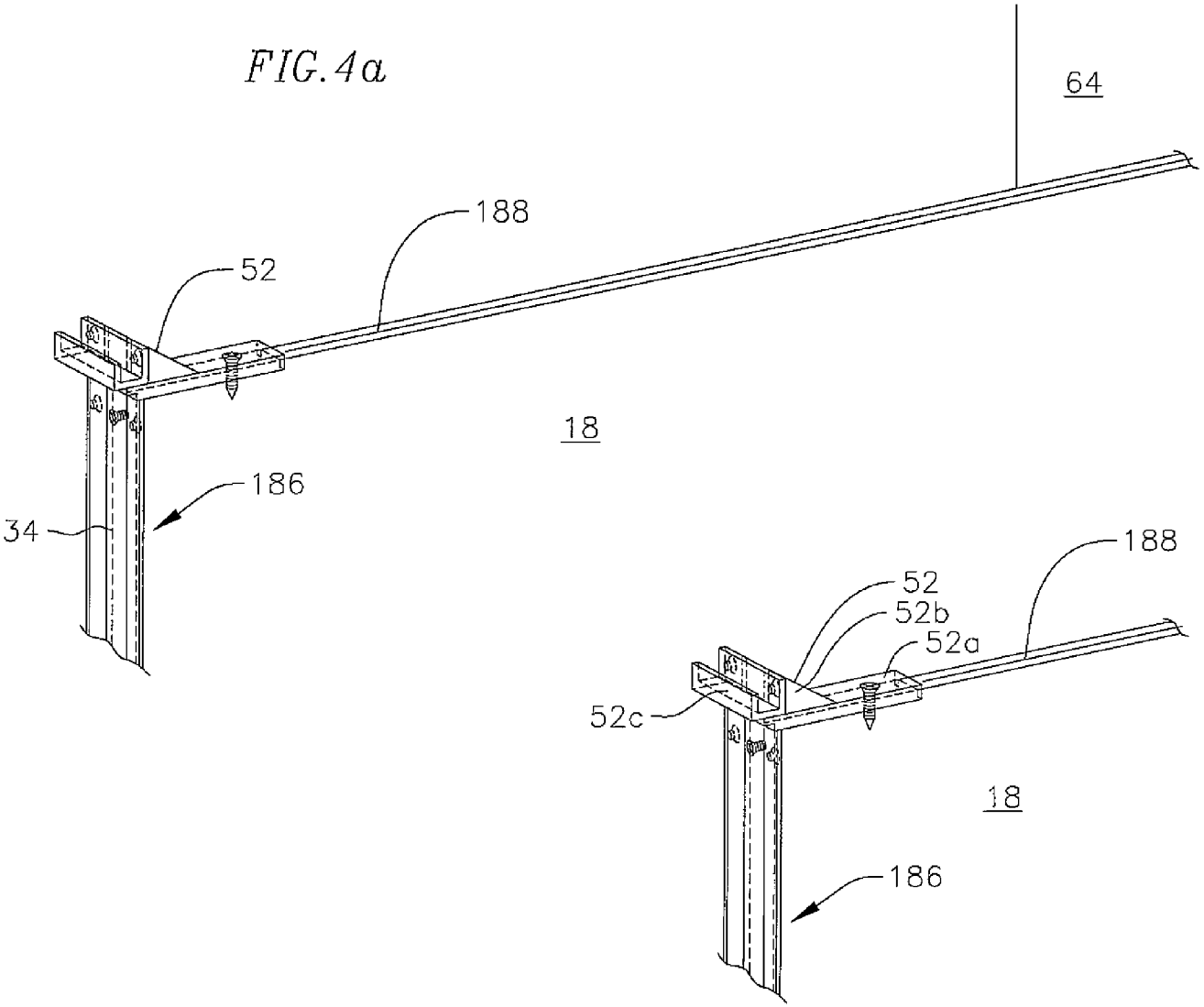
FIG. 4*a* is a partial perspective elevation view of an embodiment of the partition system of the present disclosure showing a plurality of side panels installed along a rear wall and rail attachment brackets attached to a top surface of each side panel for receiving a flush-mounted head rail.
Figure 4B:
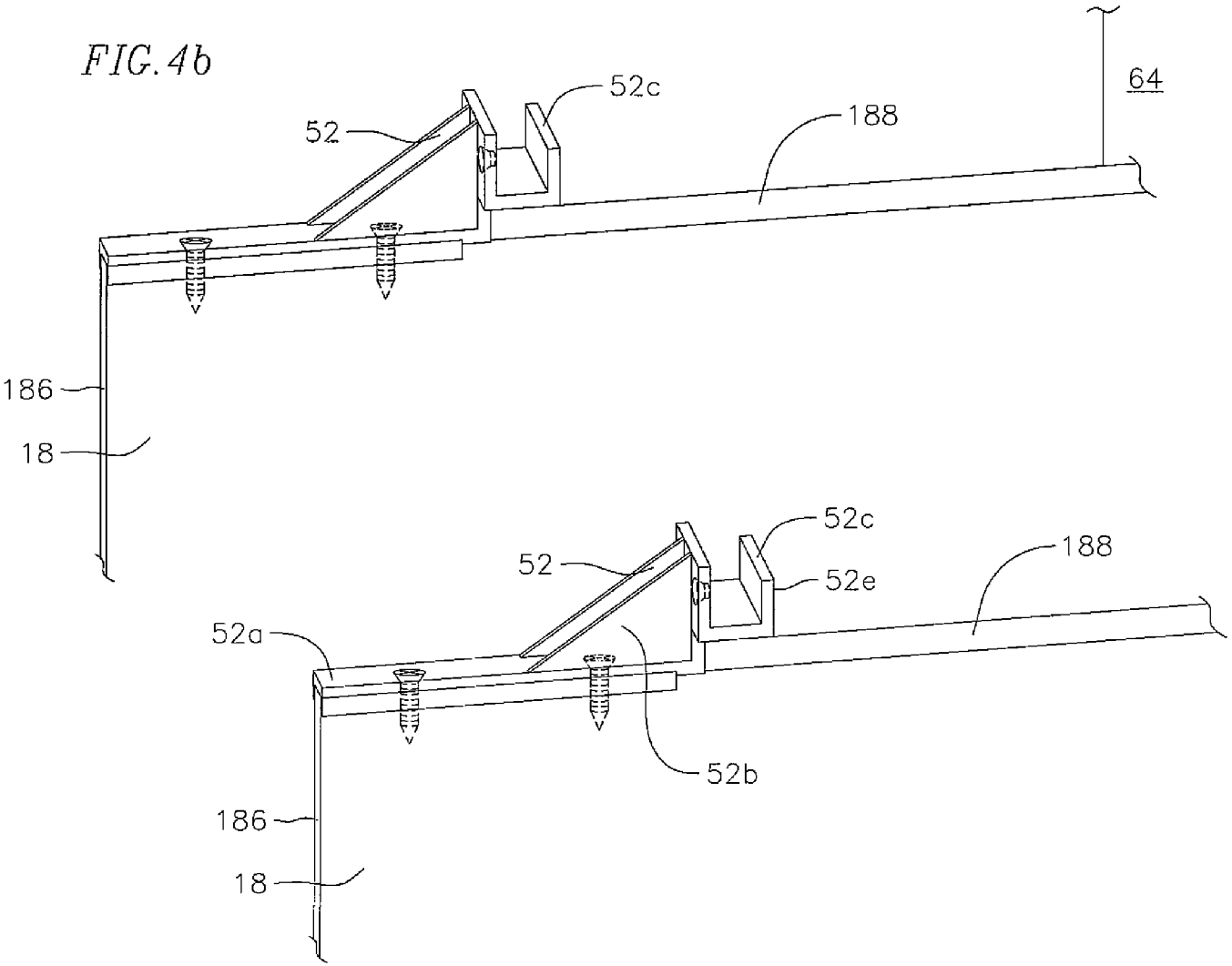
FIG. 4*b* is a partial perspective elevation view of an embodiment of the partition system of the present disclosure showing a plurality of side panels installed along a rear wall and rail attachment brackets attached to a top surface of each side panel for receiving a retracted head rail.
Figure 5A:
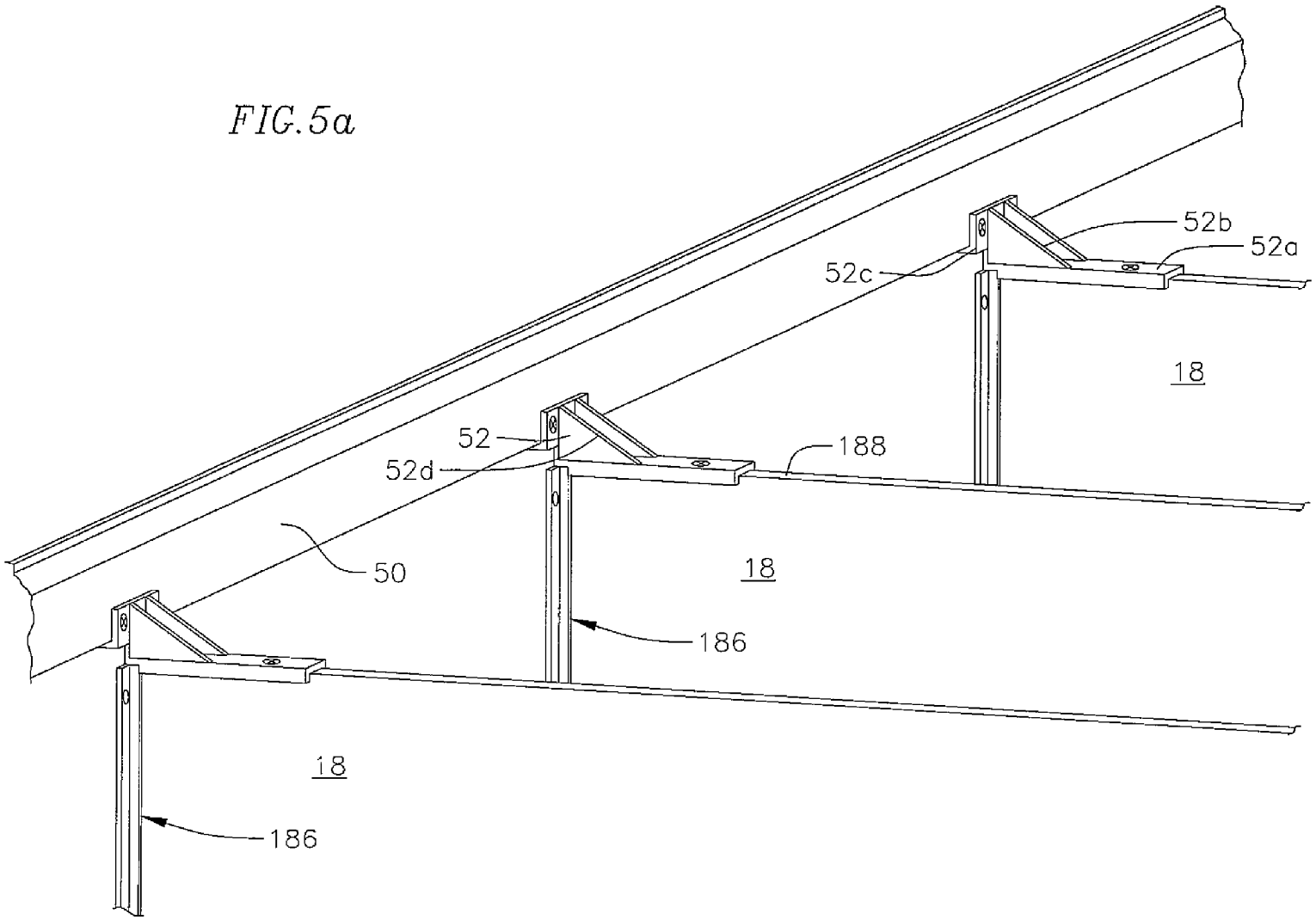
FIG. 5*a* is the partial perspective view of the embodiment of FIG. 4*a* showing the flush-mounted head rail attached to the rail attachment brackets.
Figure 5B:
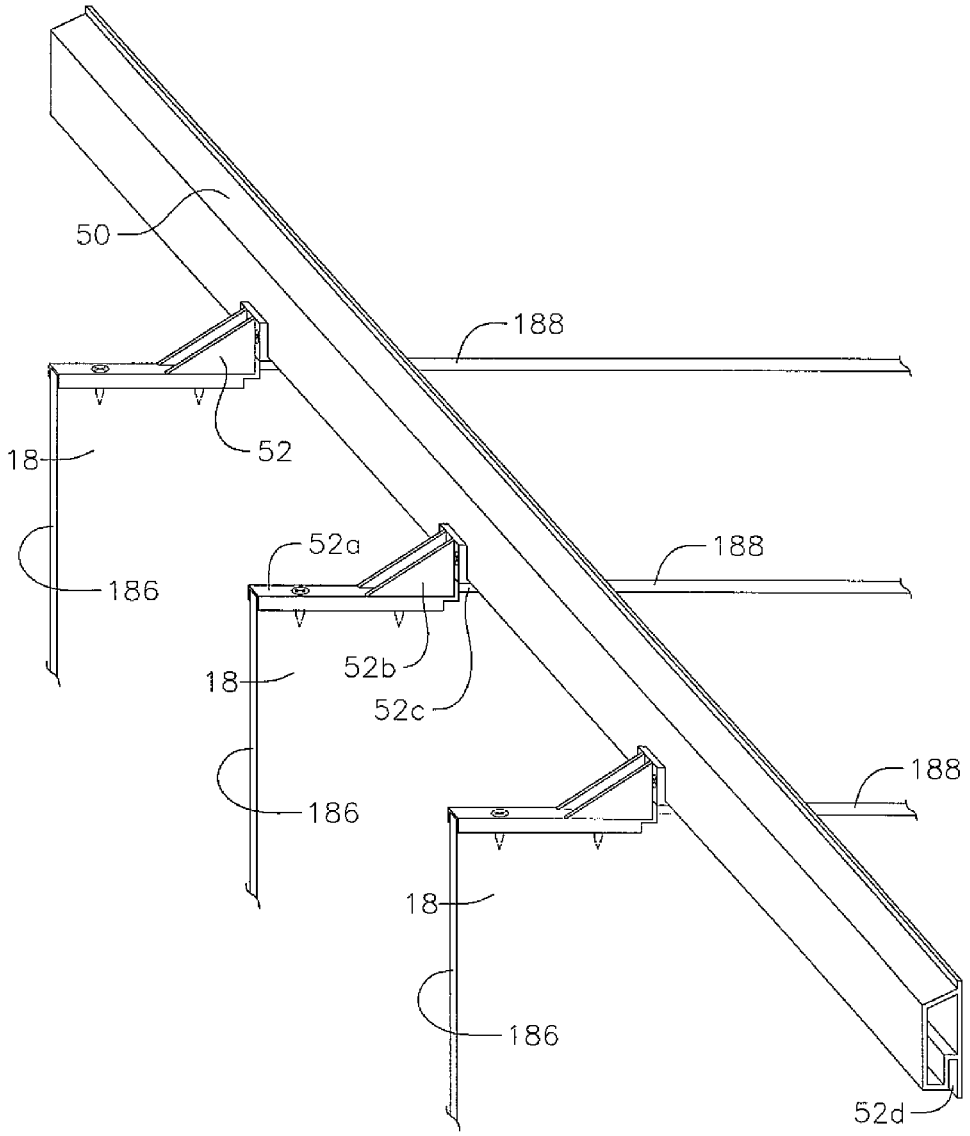
FIG. 5*b* is the partial perspective view of the embodiment of FIG. 4*b* showing the retracted head rail attached to the rail attachment brackets.

With reference now to FIGS. 4*a*, 4*b*, 5*a*, and 5*b*, optionally in some embodiments, the partition system 100 may include a head rail 50. The head rail 50 is configured to provide additional stability and structural support, for example in a lateral direction, for the partition system 100, and an example embodiments at the side panels 18. Additionally, the head rail 50 may be used to support additional panel members above the doors 16, stiles 10, 12, 14, or side panels 18. In some embodiments, the head rail 50 is attached directly to the side panels 18, and is independent from the doors 16 or the stiles 10, 12, 14. In one embodiment, the head rail 50 is connected to at least two side panels 18 via a rail connection member 52, as shown in FIGS. 5*a* and 5*b*. The head rail 50 may be connected to any number of adjacent side panels 18 or other members, as shown in FIGS. 4*a* and 4*b*. In one embodiment, the rail connection member 52 is first mounted to the top surface 188 and/or side surfaces proximate the top surface of each corresponding side panel 18. In some embodiments, as shown in FIG. 4*b*, the rail connection member 52 includes a horizontal plate 52*a* that sits on or over the top surface 188 of the side panel 18, an vertical plate such as an angled plate 52*b* (i.e., a plate having an edge such as edge 52*d* extending at an angle from the horizontal plate) protruding from the horizontal plate 52*a* such that its edge 52*d* is at an angle between 0 and 90 degrees away from the top surface 188 of the side panel 18, and a channel (or angle) 52*c* connected to the angled plate 52*b* adapted to receive the head rail 50. In the example embodiment shown in FIG. 4*b*, the connection member includes two spaced apart angled plates 52*b*. In other example embodiments, the rail connection member is just a channel (or angle) 52*c* that is coupled to the upper surface 188 of the side panel 18. In some example embodiment, a channel leg 52*e* (FIG. 4*b*) of the channel 52*c* may be received in a slot 52*d* defined in the head rail, as for example shown in FIG. 5*b*.

Figure 8:
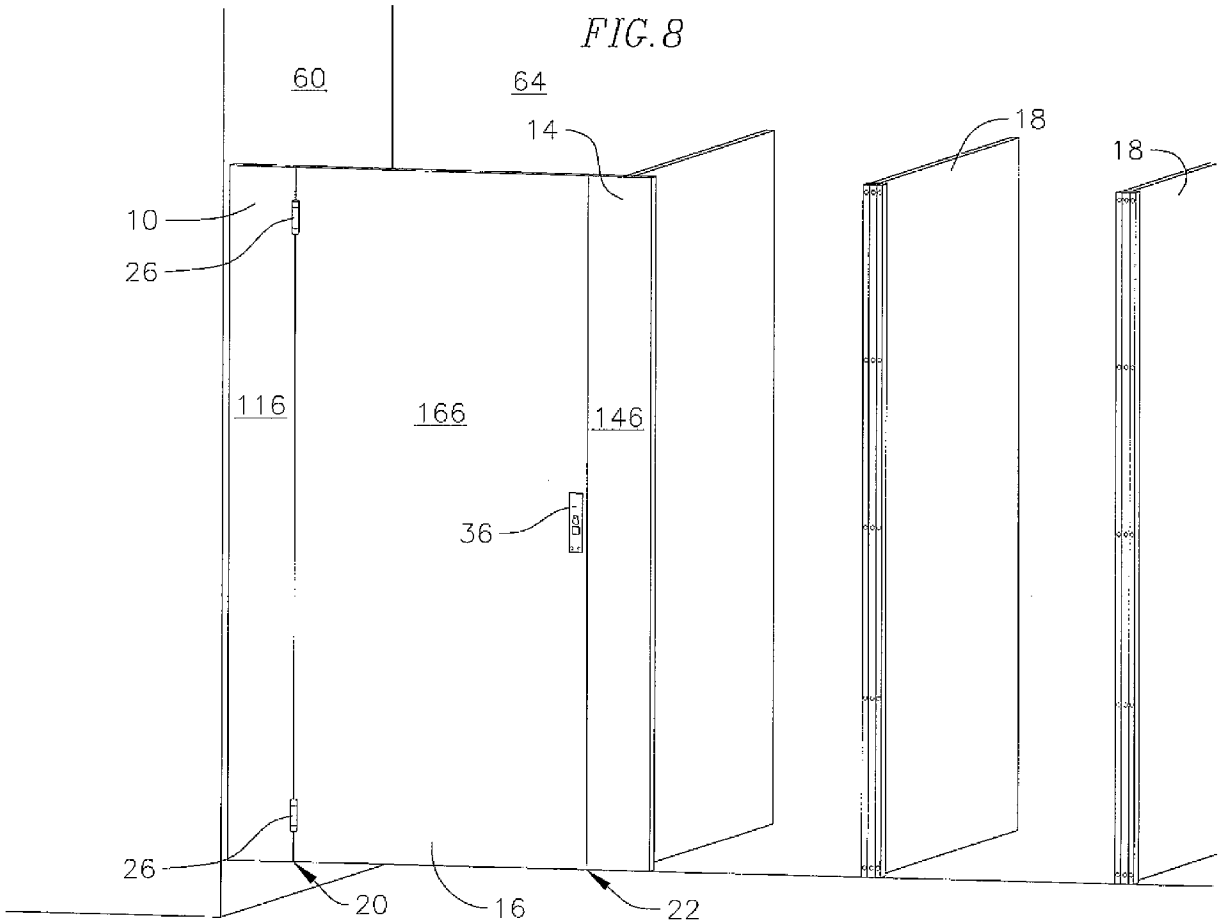
FIG. 8 is a front elevation view of the door assembly of FIGS. 7*a* and 7*b* with the door in a closed position.
Figure 9A:
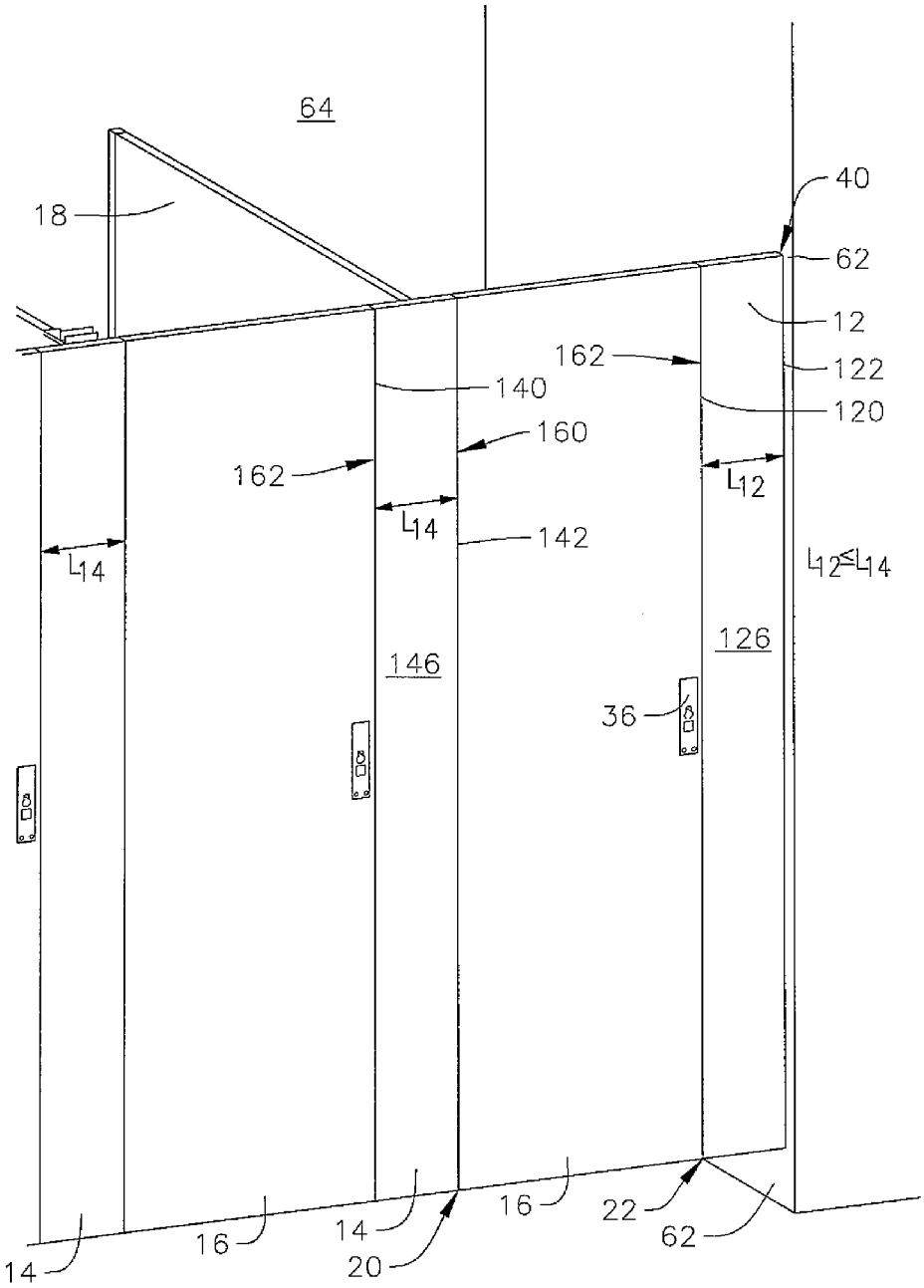
FIG. 9*a* is a perspective front elevation view of an embodiment illustrating the attachment of a second end stile to a side panel.

In some embodiments, the rail connection member 52 is inset from the front surface 116, 126 of each stile and corresponding door of the partition system 100 such that the head rail 50 is set back a specified distance from the front surface of the partition system 100, as shown in FIG. 5*b*. In other embodiments, the head rail 50 is flush with the front surface 116, 126 of the partition system 100, as shown in FIG. 5*a* (the front surfaces of the stiles are shown in FIGS. 8 and 9*a*). In one embodiment, the rail connection member 52 is attached to the top surface 188 and/or side surface of each side panel 18 at a specified distance from the second end 18*b* or the first end 184 of the side panel 18. The head rail 50 can be any suitable material as will be appreciated by those skilled in the art. The head rail can be cut to an appropriate length at the installation site. In one embodiment, the head rail 50 can be solid aluminum. In one embodiment, the head rail 50 in conjunction with the connection of the first end stile 10 to the first side wall 60, and the connection of each side panel 18 to the back wall 64, provides sufficient structural support for the partition system 100 such that partition system does not require floor supports 42, and the partition system 100 is fully suspended from the first side wall 60, the rear wall 64, and/or the second side wall 62.

Figure 11A:
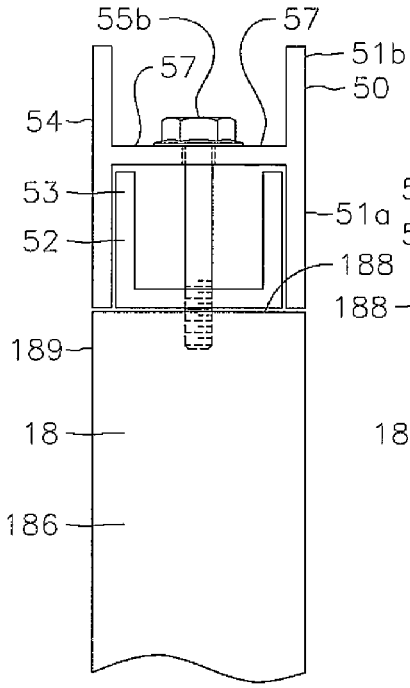
FIGS. 11*a*, 11*b* and 11*c* are front, side and perspective views, respectively of other example embodiment rails connecting flush with a side panel portion.
Figure 11B:
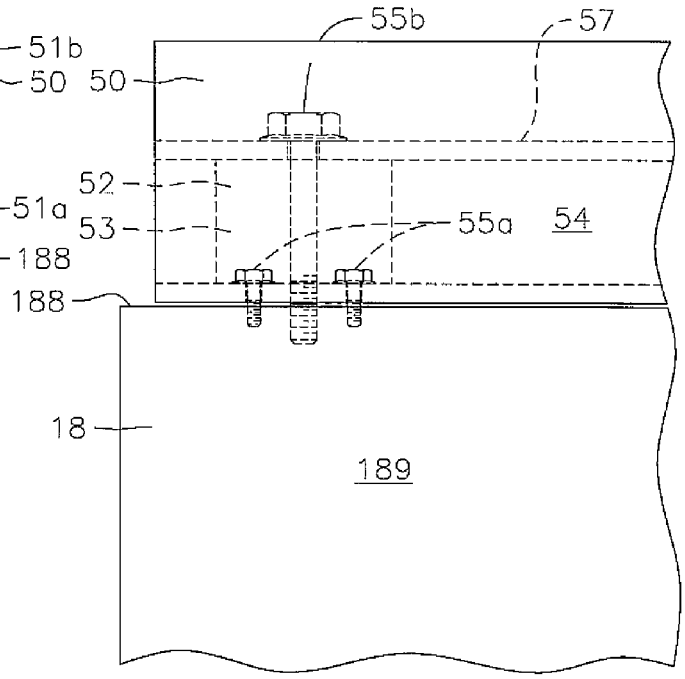
Figure 11C:
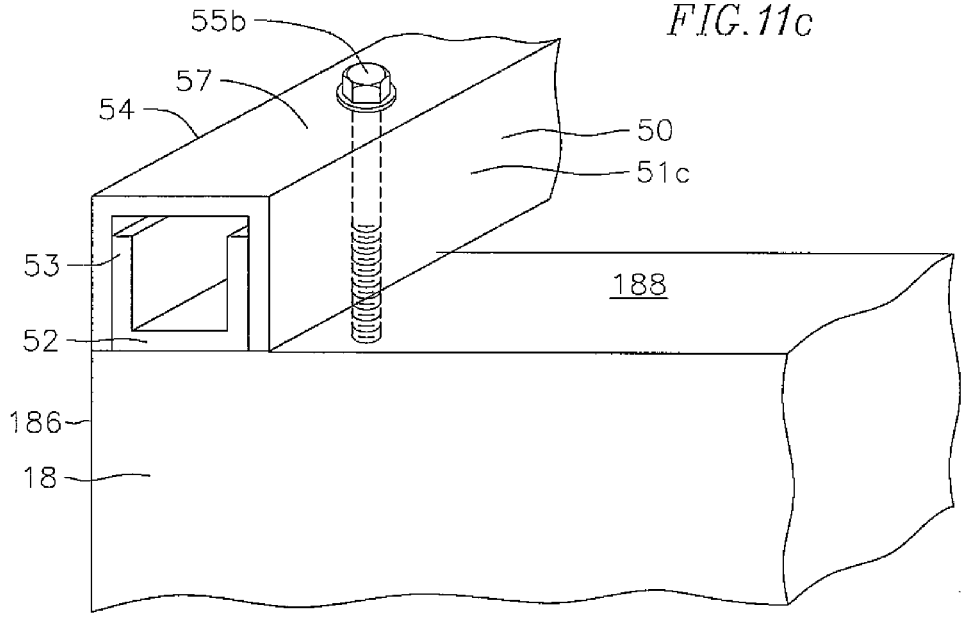

In other embodiments where the head rail is desired to be to be flush with the second (or front end surface) 186 or with a side surface 189 of its side panel 18, a rail connection member may be used, as for example rail connection member 53 shown in FIGS. 11*a*, 11*b* and 11*c*, over which is fitted the head rail 50. In an example embodiment, the rail connection member 53 is a channel member which is fastened to the top surface 188 of the side panel. The head rail also defines a channel. In one example, the head rail defines an "H" in cross-section, as for example disclosed in FIGS. 11*a* and 11*b* which defines two abutting channels 51*a* and 51*b*, or may it may be just a single channel 51*a*, as for example shown in FIG. 11*c*. The head rail channel 51*a* fits over the connection member 53 such that a surface 54 of the head rail is flush with a desired surface, as for example side surface 189 (FIGS. 11*a* and 11*b*) or end surface 186, as for example shown in FIG. 11*c* of the side panel 18. In an example embodiment, the head rail channel 51*a* fits snuggly over the connection member 53 such that lateral movement of the head rail relative to the connection member is minimized or alleviated. In an example embodiment, the connection member is fastened to the upper surface 188 of the side panel 18, as for example by using two fasteners 55*a*, as for example shown in FIG. 11*b*. A fastener 55*b* is then fastened through a lateral surface 57 of the head rail. The lateral surface 57 is the surface that interconnects the two legs that define the channel 51*a*. In other embodiments, a single fastener 55*b* is used that penetrates and/or is fastened to the lateral surface 57 of the head rail, penetrates and/or is fastened to the connecting member 53, and fastens into the side panel 18, as for example shown in FIG. 11*a*. The use of a head rail that is flush with a surface, as for example the side surface 189 of the panel 18, and which hides the connecting member 53 is desirable, especially when the partition system is installed against only one side wall and a panel 18 is used to define the end of the partition system. In such example embodiments, the head rail has to go over and along the upper surface 188 of the side panel 18 defining the end of the partition system. On such side panel defining the end of the partition, the head rail cannot be offset so that it would not be visible from outside of the partition system. In such case, this example embodiment provides for a cleaner connection between the head rail and the panel 18 by hiding the connecting member inside the head rail. In such an embodiment, the head rail forms a 90° angle such that a first portion of the rail runs across the side panels and a second portion perpendicular to the first portion running along the side panel defining the end of the partition. In an example embodiment, the two portions have ends that are mitered at 45° and the mitered ends are connected to each other using well known methods to form the head rail. In embodiments, the head rail may also be connected to both side walls or to a side wall and a rear wall when the partition is installed in a location including only one side wall.

Figure 3B:
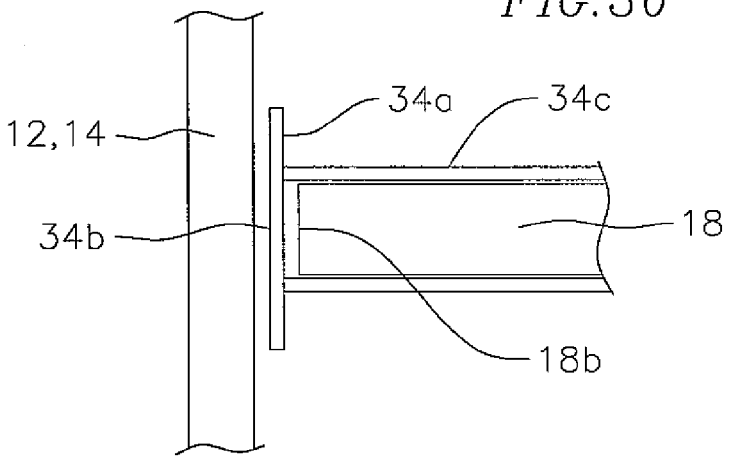
FIGS. 3*b*, 3*c* and 3*d* are schematic top views of a side panel 18 coupled to a style 12, 14.
Figure 3C:
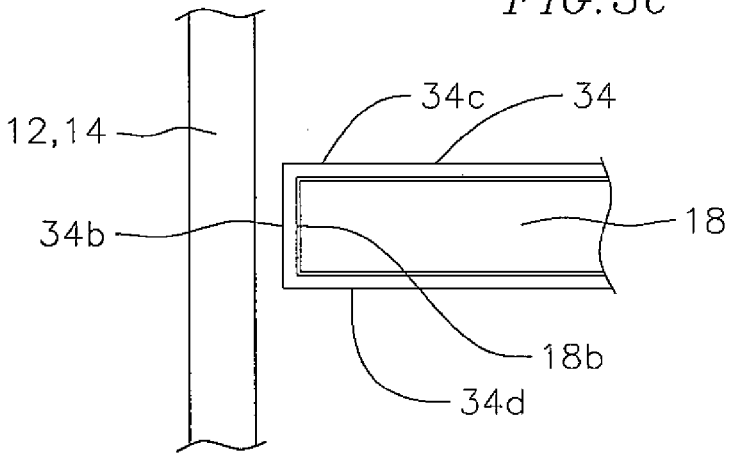
Figure 3D:
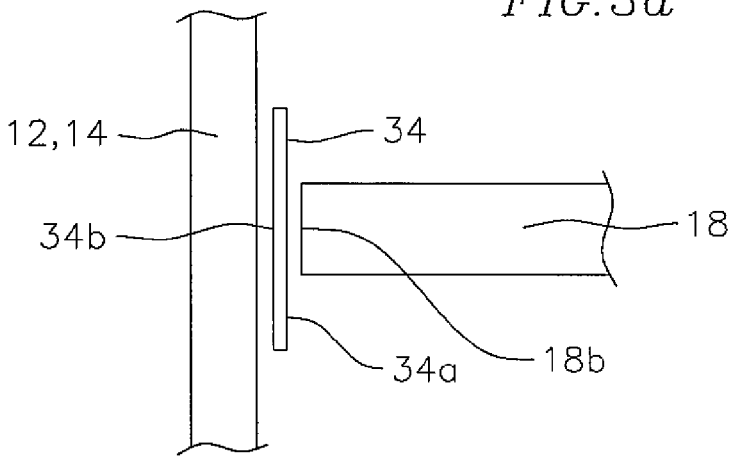
Figure 9B:
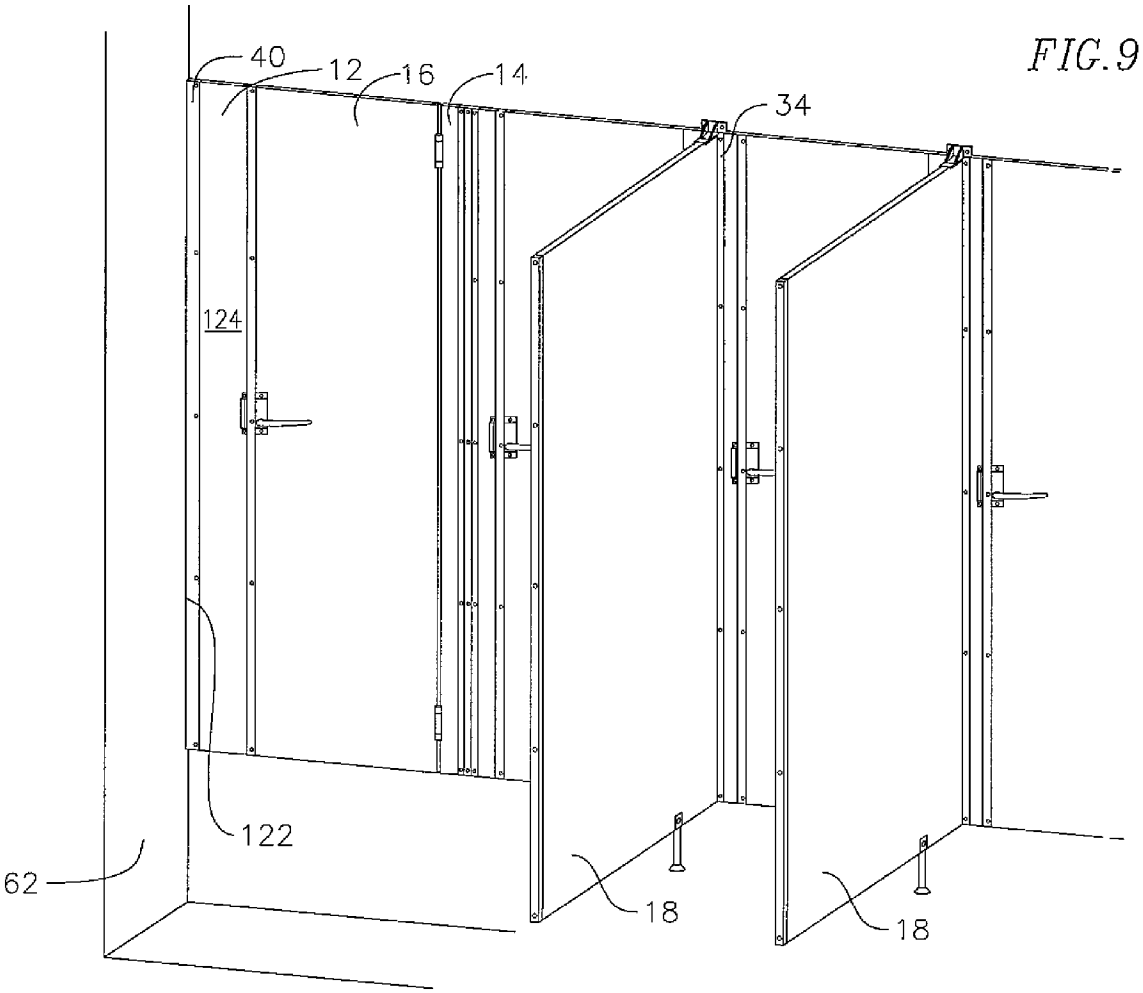
FIG. 9*b* is a perspective rear elevation view of the embodiment of FIG. 9*a* illustrating the attachment of the second end stile to the second side wall.

With reference now to FIG. 3*a*, in some embodiments, each side panel 18 includes panel connection member 34 at a second end 186, opposite the first end 184, of the side panel 18. In some embodiments, the panel connection member 34 is configured to be attached to and support an interior stile 14 or a second end stile 12 attached in a plane substantially perpendicular to the side panel 18, as shown in FIG. 9*b*. In one embodiment, the panel connection member 34 is a plate 34*a* having a relatively flat surface 34*b* on one face, and a channel 34*c* extending opposite the face, such that the second end 186 of the side panel 18 is sandwiched in the channel portion of the panel connection member 34, and the face having a relatively flat surface is connected to a stile 12, 14, as for example shown FIG. 3*b*. In other example embodiments, the connection member 54 is just a channel 34*c*, as shown in FIG. 3*c* or a flat plate is shown in FIG. 3*d*. In embodiments of the present disclosure, the panel connection member 34 runs along the entire length of the side panel 18. In one embodiment, the panel connection member 34 runs along only a portion of the length of the side panel 18. The connection member 34 may be fastened or otherwise adhered to the side panel 18 used the stile 12, 14.

In some embodiments of the present disclosure where the room 104 in which the partition system 100 is installed only has a first side wall 60 to which the partition system 100 is attached, the partition system 100 may include an additional side panel 18 in lieu of a second side wall 62. In these embodiments, the second end stile 12 attaches to a side panel 18 at the panel connection member 34. The panel connection member 34 in these embodiments may have a portion attached along a portion of the length of the second end 186 of the side panel 18, and a portion attached along a portion of the length of the second end stile 12 on a rear surface 124 at a second edge 122 of the second end stile 12. In other embodiments, the side panel 18 connected to the second end stile 12 may not include a panel connection member 34, and the second end stile 12 may be connected to the side panel 18 via a second stile bracket 40 (as shown in FIG. 10*b*). In some embodiments, the second stile bracket 40 is an angle. In these embodiments, the second stile bracket 40 may be attached to the side panel 18 proximate the second end 186 on an interior face of the side panel 18, along a portion of the length of the side panel 18, and along the second end stile 12 proximate the second end stile second edge 122.

With reference now to FIGS. 1, 6*a*, and 6*b*, each stall door 16 of the partition system 100 is rotatably coupled or connected to a stile 10, 12, 14, at one edge 160, 162 of the door 16, such that a first seam 20 is created where the stile 10, 14, connects to the door 16 at the rotatable connection. The door 16 is rotatably connected to the stile 10, 14 through the hinge member(s) 26. In embodiments where the hinge member 26 includes two complementary hinge elements 26*a*, 26*b*, the hinge member may be a spring-loaded, force-adjustable hinge having two complementary hinge elements 26*a*, 26*b*. In one embodiment, the hinge member 26 includes at least one recessed hinge. In one embodiment, the hinge member 26 includes at least one surface mount barrel hinge. Other hinge members well known in the art may be used.

Figure 6C:
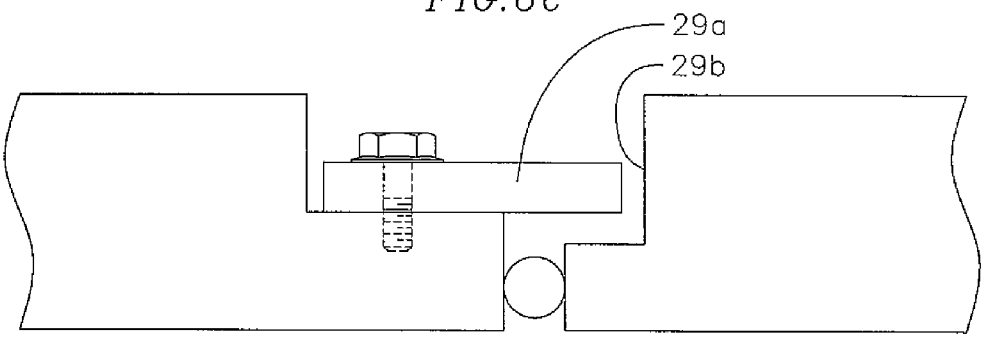
FIG. 6*c* is a partial top view of an embodiment with the door in a closed position, illustrating the line of sigh eliminating first seam.
Figure 7C:
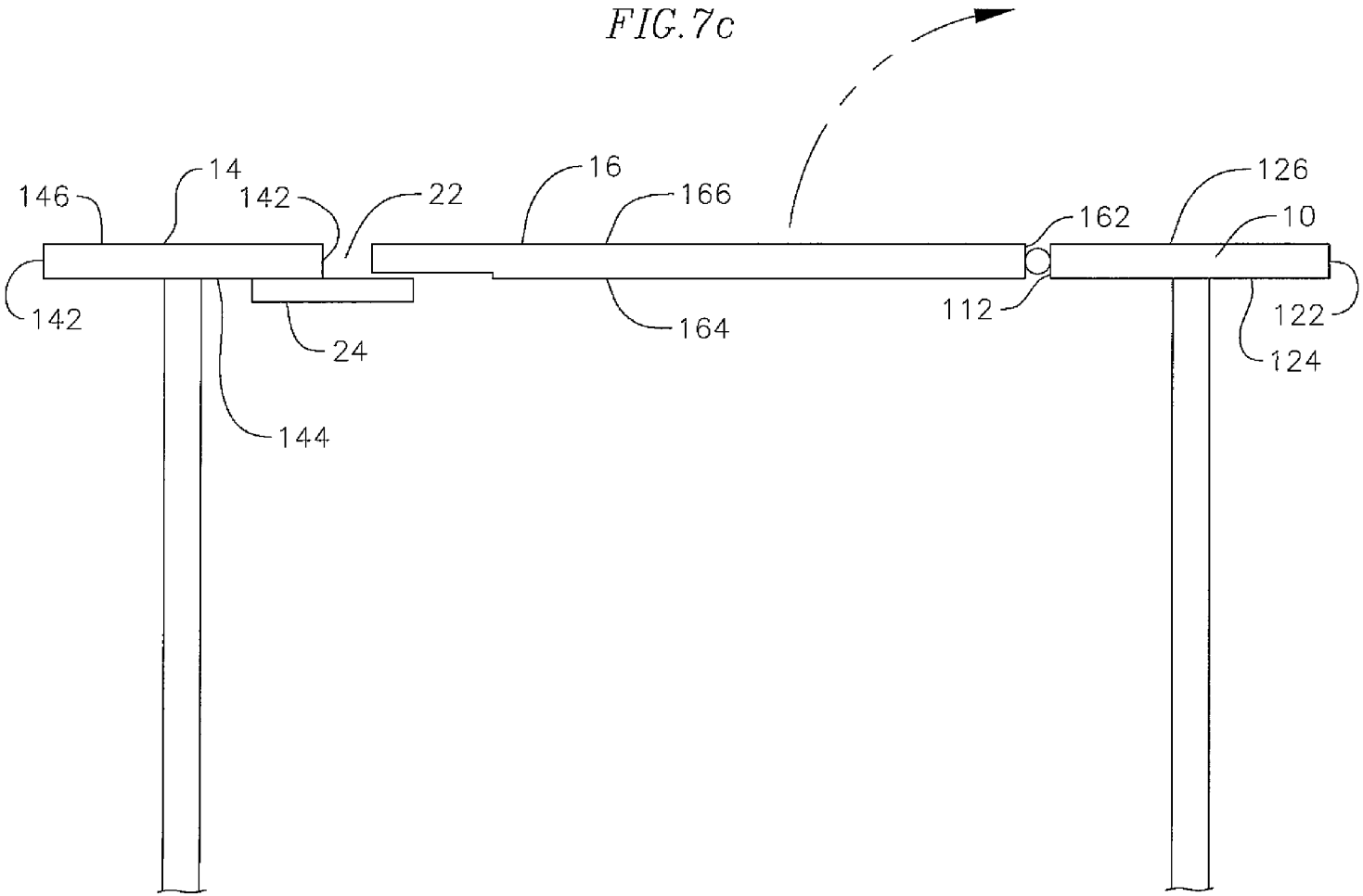
FIG. 7*c* is a partial top view of the embodiment of FIG. 7*b*.

With continued reference to FIGS. 6*a* and 6*b* and with reference to FIGS. 7-8, in embodiments of the present disclosure, a plate member 28*a* is provided that runs along a portion of the length of the first seam 20 and complements the hinge member 26. In one embodiment, the plate member 28*a* runs at least along the entire length of the first seam 20 except where interrupted by the hinge member(s) 26. In another example embodiment, multiple plate members maybe used such that a hinge may be located between plate members. In one embodiment, the plate member 28*a* is part of an angle member 28 which includes a transverse member 28*c* extending transversely from plate member 28*a*. A receiving portion, such as a channel 28*b* receives the plate member 28*a*. In one example embodiment, the receiving channel 28*b* is part of the door 16, and the plate member 28*a* is part of the stile 10, 14, as shown in FIG. 6*a*. In other example embodiments, the plate member 28*a* is part of the door 16, and the receiving channel is part of the stile 10, 14. The plate member 28*a* is configured to be received in the channel 28*b* upon closing of the door 16 such that when the door 16 is closed, the plate member 28*a* blocks a line of sight through the gap 21 defining the first seam 20 at the connection of the door 16 to the stile 10, 14 along the rotatably connected edge 112, 142. In these embodiments, the plate member(s) prevents line of sight visibility through the first seam. In example embodiments, the plate member 28*a* is part of the stile 10, 14, or it is attached to the stile 10, 14 along the second edge 112, 142 of the stile 10, 14, where the stile connects to the door 16, as for example shown in FIG. 7*c*. In one embodiment, the angle 28 is attached to the stile 10, 14 and the plate member 28*a* configured to be received by a channel 28*b* attached to the door 16, as for example shown in FIG. 7*c*. In other example embodiments, the plate member may be a simply a plate 29*a* that is fastened or otherwise attached to the door or the stile such that when the door closes it is received in a space on the other of the door of the stile (FIG. 6*c*). The space can be a channel formed on such member or it may be a recess 29*b*. In other embodiments, a single plate member 28*a* is positioned along the entire first seam. In this regard, the plate will have to be placed in front or behind the hinges.

With continued reference to FIGS. 6*a*-8, in embodiments of the present disclosure, the door 16 can be rotatably connected or coupled to a stile 10, 12, 14, and configured to rotate in either a first or outward direction, or a second or inward direction toward the inside of the stall 102. In one embodiment, a first door 16 is rotatably coupled to the first end stile 10, rotating in a first or outward direction about the first end stile 10. The door 16 of this embodiment is configured to be in a closed position at the adjacent interior stile 14. In other embodiments, the first door 16 can be rotatably coupled to the adjacent interior stile 14, and configured to be in a closed position at the adjacent first end stile 10. In other embodiments, each door 16 may be rotatably coupled to its respective stile 10, 12, 14, and configured to rotate in a different direction from an adjacent door 16. In embodiments where the door is configured to be rotatably connected or coupled to a stile 10, 14 at or proximate the first edge 160 of the door 16, and the second edge 112, 142 of the stile, and to rotate in a second or inward direction toward the inside of the stall 102, the door, may further include a plate member 24 attached to the door 16, as for example shown in FIG. 6*a*. In these embodiments, the plate member 24 is attached to a rear surface 164 of the door 16 along the second edge 162 and extending laterally a specified distance past the second edge 162 of the door. Accordingly, a portion of the door plate member 24 along the second edge 162 of the door 16 is visible from the front surface 166 of the door 16 through the second seam 22. In these embodiments, a portion of the plate member 24 is configured to overlap with the first edge 120, 140 on the rear surface 124, 144 of the adjacent stile 12, 14 when the door 16 is in a closed position, defining a second seam 22. The plate member 24, runs along at least a portion of the length of the door 16 and/or the stile 12, 14, and prevents a line of sight through the seam 22. In these embodiments, the second seam 22 is a line of sight-eliminating seam when the door is in a closed position in that the plate member prevents viewing through the second seam 22.

In embodiments where the door is configured to be rotatably connected or coupled to a stile 10, 14 at or proximate the first edge 162 of the door 16, and the second edge 112, 142 of the stile, and to rotate in a first or outward direction away from the inside of the stall 102, the plate member 24 is attached to the stile 12, 14 at the first edge 122, 142, rather than being attached to the door 16. In these embodiments, the plate member 24 is attached to a rear surface 124, 144 of the stile 12, 14 along the first edge 120, 140 and extends laterally a specified distance past the first edge 120, 140 of the stile 12, 14, as for example shown in FIGS. 7*b* and 7*c*. Accordingly, a portion of the plate member 24 along the first edge 122, 142 of the stile 12, 14 is visible from the front surface 126, 146 of the stile 12, 14. In these embodiments, a portion of the plate member 24 is configured to overlap with the second edge on the rear surface 164 of the door 16 when the door 16 is in a closed position, defining the second seam 22, where the plate member 24 prevents a line of sight viewing through seam 22 when the door 16 is in a closed position. In embodiments, there is a line of sight viewing elimination along the first seam 20 and a line of sight viewing elimination along the second seam 22 when the door is in a closed position.

In some embodiments, the door 16 further may include a door locking mechanism 36, and/or handle mechanism 38, and other accessories suitable for installation with a partition system 100. Such locking mechanisms are well known in the art.

With reference now to FIGS. 9*a* and 9*b*, in some embodiments, the second end stile 12 of the partition system 100 is connected to the second side wall 62 via a second stile bracket 40. In some of these embodiments, the second stile bracket 40 is an angle or a channel. The second stile bracket 40 is configured to be attached abutting the second side wall 62. In embodiments of the present disclosure, the second stile bracket 40 is attached to the second side wall 62 such that the second stile bracket 40 extends vertically along the second side wall 62. In embodiments where the second end stile 12 is attached to a second stile bracket 40, a portion of the second end stile 12 proximate the first edge 120 is attached to the second stile bracket 40 and adjusted such that a second edge 122 of the second stile bracket 12, opposite the first edge 120, is vertically plumb relative to a reference point. When attached in this manner, the second end stile 12 (i.e., the second edge of the second end stile) is perfectly plumb, even where the second side wall 62 and the second stile bracket 40 are not, relative to the vertical plane. In some embodiments where the second stile bracket 40 is an angle, the second end stile 12 is attached to the second stile bracket 40 proximate a second edge 122 of the second end stile 12, on a rear surface 124. In some embodiments, the second stile bracket 40 extends the entire length of the second end stile 12. In other embodiments, the second stile bracket 40 extends only along a portion of the length of the second end stile 12. In some embodiments, the second end stile 12 is suspended, meaning it is not connected to the floor or ceiling.

With reference now to FIGS. 10*a* and 10*b*, in other embodiments of the present disclosure where the room 104 in which the partition system 100 is installed only has a first side wall 60 to which the partition system 100 is attached, the partition system 100 may include an additional side panel 18 in lieu of a second side wall 62. In these embodiments, the second end stile 12 attaches to the side panel 18 at the panel connection member 34 or at a second stile bracket 40 such that the second end stile 12 is fully structurally supported by the side panel 18, and the second end stile 12 may be suspended, meaning it is not connected to the floor or ceiling. The panel connection member 34 in these embodiments may be an angle where one flange of the angle is attached along a portion of the length of the second end 186 of the side panel 18, and a second flange of the angle is attached along a portion of the length of the second end stile 12 on a rear surface 124 proximate the second edge 122 of the second end stile 12. In other embodiments, the side panel 18 connected to the second end stile 12 may not include a panel connection member 34, and the second end stile 12 may be connected to the side panel 18 via a second stile bracket 40. In some embodiments, the second stile bracket 40 is an angle. In these embodiments, the second stile bracket 40 may be attached to the side panel 18 on the second end 186 at an interior face of the side panel 18, along a portion of the length of the side panel 18, and to or proximate to the second edge 122 of the second end stile 12.

A method of installing the partition system 20 according to embodiments of the present disclosure includes attaching the first end stile 10 to the first side wall 60 by first attaching the first stile bracket 30 to the first side wall 60, such that the first stile bracket 30 extends vertically along the first side wall 60. The method then includes attaching a first end stile 10 proximate the first edge 110 to the first stile bracket 30 and adjusting the first end stile 10 such that the second edge 112 of the first end stile 10, opposite the first edge 110, is vertically plumb relative to a reference point.

The method then includes the task of attaching each side panel 18 to the rear wall 64, by first attaching each panel bracket 32 such that each panel bracket 32 extends vertically along the rear wall 64. The method then includes attaching the first end 184 of each side panel 18 to each panel bracket 32 and adjusting each side panel 18 such that the second end 186 of each side panel 18, opposite the first end 184, is vertically plumb relative to a reference point. In some embodiments where the partition system 100 is not connected to a second side wall 62, and is instead connected to a side panel 18, one additional side panel 18 may be installed according to the same method in line with the second edge 122 of the second end stile 12. In some embodiments where the side panel 18 includes optional floor supports 42 at the bottom surface 190 of each side panel 18, the task of attaching each side panel 18 may include the additional task of leveling each floor support 42, by adjusting the height of the floor support 42 to a desired height in order to keep the side panel 18 plumb, according to some embodiments. In one embodiment, the task further includes mounting the floor supports 42 to the flooring surface, for example through a screw system, silicone, or other mounting mechanism after leveling the floor support 42. In some embodiments, the floor supports 42 are self-leveling pedestals and do not require the additional task of leveling the floor support 42.

The method next includes the task of installing a door 18 adjacent to a stile 10. The task of installing the door 18 includes rotatably coupling the first edge 160 of the door 18 to the second edge 112 of the adjacent stile 10, such that the door 16 is rotatable from an open position to a closed position. Rotatably coupling the door 18 to the second edge or proximate the second edge 112 of the respective adjacent stile 10 includes coupling the first hinge element 26*a* of the hinge member 26 (which is attached to the door or the stile) to the complementary second portion of the hinge element 26*b* (which is attached to the other of the door or the stile) such that the door 16 is rotatably coupled to the stile 10 via the hinge member 26. The plate member 28*a* and its receiving channel 28*b* or recess 29 may be pre-installed on the door and stile or may be installed after installation of the door(s). Similar the plate 24 may be pre-installed or may be installed after the door(s) is installed.

The method further includes the task of installing an interior stile 14 adjacent to and at the second edge 162 of the door 16. The task of installing the interior stile 14 includes attaching the rear surface 144 of the interior stile 14 to the second end 186 of the respective side panel 18 via the panel connection member 34. The task includes installing the interior stile 14 to the side panel 18 such that a portion of the first edge 140 of the interior stile 14 is adjacent with a portion of the second edge 162 of the door 16 when the door 16 is in a closed position. The portion of the second edge 162 of the door that is adjacent with the portion of the first edge 140 of the interior stile 14 creates the second seam 22. The method further includes repeating the tasks of installing the door 16 followed by installing the interior stile 14 until all of the doors 16 of the partition system 100 have been attached.

In some embodiments, the method then includes the task of attaching the second end stile 12 to the second side wall 62. In some embodiments, the task of installing the second end stile 12 may include measuring the required width of the second end stile 12 from the adjacent door 16 to the second side wall 62, and cutting the second end stile 12 to the required width. The task further includes attaching the second edge 122 of the second end stile 12 to the second side wall 62, as for example by attaching the second stile bracket 40 to the second side wall 62 such that the second stile bracket 40 extends vertically along the second side wall 62. The method then includes attaching a portion of the second end stile 12 proximate the first edge 120 to the second stile bracket 40 and adjusting the second end stile 12 such that the second edge 122 of the second end stile 12, opposite the first edge 120, is vertically plumb relative to a reference point In some embodiments where the second end stile 12 is connected only to a side panel 18 and not to the second side wall 62, the task of attaching the second end stile 12 may include measuring the required width of the second end stile 12 from the adjacent door 16 to the last side panel 18, and cutting the second end stile 12 to the required width. The task further includes attaching the rear surface 124 of the second end stile 12 to the second end 186 of the adjacent side panel 18 by attaching a rear surface 124 portion of the second end stile proximate the second edge 122 to the side panel 18 which may be fitted with a second stile bracket 40 rather than a panel connection member 34. The task includes attaching the second stile bracket 40 vertically along the second end 186 or a portion of a side surface of the side panel 18 proximate the second end 186 and then attaching the second end stile 12 at or adjacent its second edge 122 to the second stile bracket 40. In some embodiments, the second end stile 12 may be attached to the side panel 18 via the panel connection member 34, where the panel connection member 34 is an angle or a plate.

In some embodiments, the method further includes the optional task of installing a head rail 50 by attaching the head rail 50 directly to the side panels 18 via the rail connection member 52 (or 53), as shown in FIGS. 5*a* and 5*b*. In one embodiment the task includes, first mounting the rail connection member 52 (or 53) to the top surface 188 of each corresponding side panel 18 after the side panel 18 has been attached to the rear wall 64, to receive the head rail 50, as shown in FIGS. 4*a*, 4*b*, 11*a*, 11*b*, and 11*c*.

Figure 12:
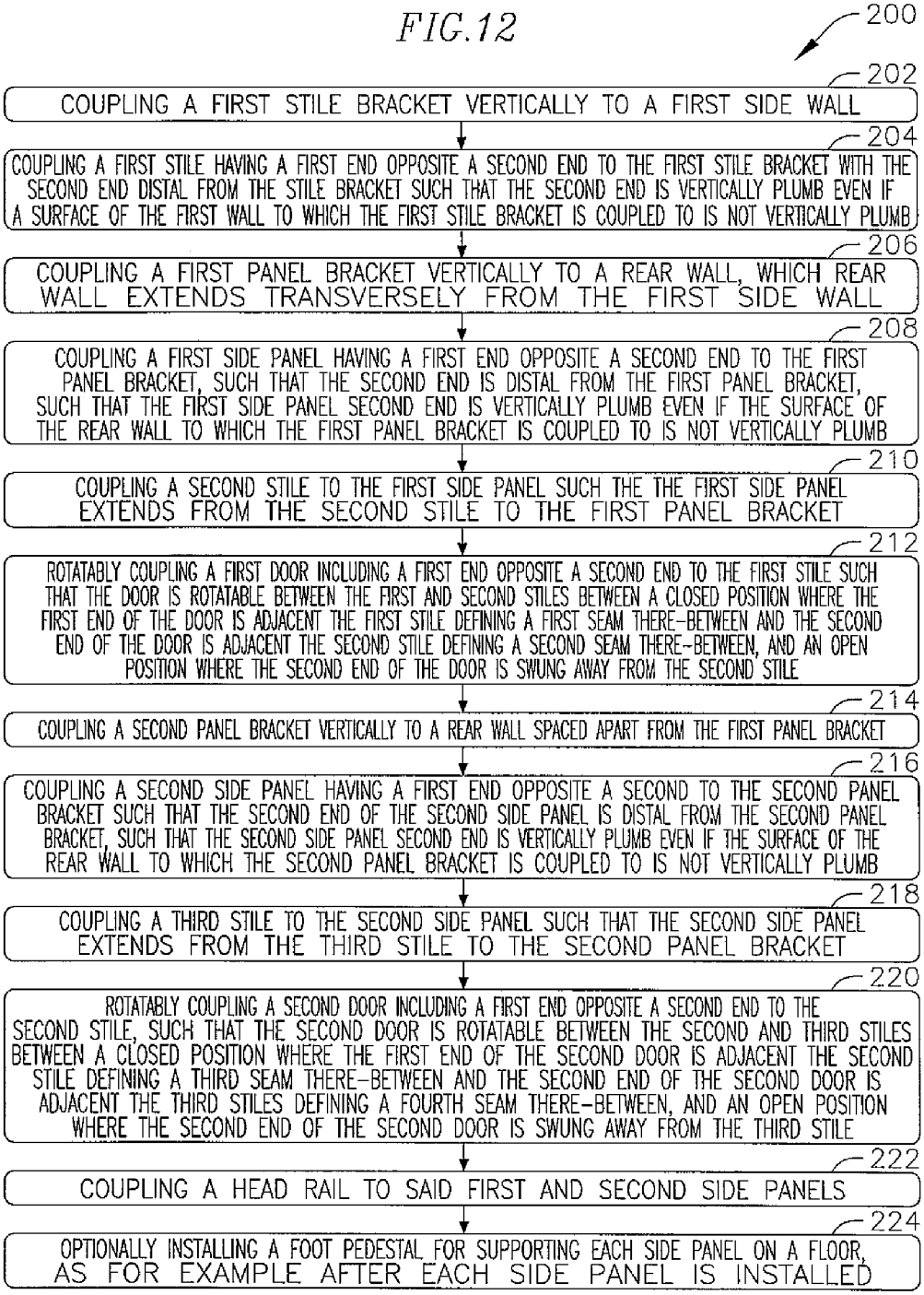
FIG. 12 depicts a flow chart of an example embodiment partition installation method.

In an example embodiment a method 200 of installation as set forth in FIG. 12 includes, coupling a first stile bracket vertically to a first side wall (block 202), coupling a first stile having a first end opposite a second end to the first stile bracket with the second end distal from the stile bracket such that the second end is vertically plumb even if a surface of the first wall to which the first stile bracket is coupled to is not vertically plumb (block 204), coupling a first panel bracket vertically to a rear wall, which rear wall extends transversely from the first side wall (block 206), coupling a first side panel having a first end opposite a second end to the first panel bracket such that the second end of the first side panel is distal from the first panel bracket, such that the first side panel second end is vertically plumb even if the surface of the rear wall to which the first panel bracket is coupled to is not vertically plumb (block 208), coupling a second stile to the first side panel such that the first side panel extends from the second stile to the first panel bracket (210), and rotatably coupling a first door including a first end opposite a second end to the first stile such that the door is rotatable between the first and second stiles between a closed position where the first end of the door is adjacent the first stile defining a first seam there-between and the second end of the door is adjacent the second stile defining a second seam there-between, and an open position where the second end of the door is swung away from the second stile (212).

The method may also include, coupling a second panel bracket vertically to a rear wall spaced apart from the first panel bracket (block 214), coupling a second side panel having a first end opposite a second end to the second panel bracket such that the second end of said second side panel is distal from the second panel bracket and such that the second side panel second end is vertically plumb even if the surface of the rear wall to which the second panel bracket is coupled to is not vertically plumb (block 216), coupling a third stile to the second side panel such that the second side panel extends from the third stile to the second panel bracket (block 218); and rotatably coupling a second door including a first end opposite a second end to the second stile such that the second door is rotatable between the second and third stiles between a closed position where the first end of the second door is adjacent the second stile defining a third seam there-between and the second end of the second door is adjacent the third stile defining a fourth seam there-between, and an open position where the second end of the second door is swung away from the third stile (block 220), and coupling a head rail to the first and second side panels (block 222). The method may also optionally include installing a foot pedestal for supporting each side panel on a floor, as for example after each side panel is installed (block 224)

According to embodiments of the present disclosure, the stiles 10, 12, 14, side panels 18, and doors 16 can be any suitable material as will be appreciated by those skilled in the art. In one embodiment, stiles 10, 12, 14, side panels 18, and/or doors 16, or any combination thereof, are a solid grade material such as high pressure laminate. In one embodiment, the stiles 10, 12, 14, side panels 18, and/or doors 16, or any combination thereof, are glass. In one embodiment, stiles 10, 12, 14, side panels 18, and/or doors 16, or any combination thereof, are aluminum. The stiles 10, 12, 14, side panels 18, and/or doors 16, or any combination thereof, can be prefabricated sizes and lengths, or can be configured to be cut-to-size in the field and/or during installation. In some embodiments, the stiles 10, 12, 14, side panels 18, and/or doors 16, or any combination thereof, are attached to the first side wall 60, the second side wall 62, the rear wall 64, or any other surface using glue, fasteners, or any other attachment means or devices suitable for these types of attachment.

It should be understood that the FIGS. are not shown to scale and that the sizing of the various components of the partition system 100 may be varied to suit particular applications.

Although the present disclosure has been described and illustrated in respect to exemplary embodiments, it is to be understood that it is not to be so limited, since changes and modifications may be made therein which are within the full intended scope of this disclosure as hereinafter claimed.

What is claimed is:

1. A partition system comprising:

a first stile;

a second stile spaced apart from the first stile;

a door rotatably coupled to the first stile about a generally longitudinal axis, wherein the door is rotatable about said generally longitudinal axis between the first and second stiles and is rotatable between a closed position where a first end of the door is adjacent the first stile defining a first seam there-between and a second end of the door opposite the first end is adjacent the second stile defining a second gap there-between, and an open position where the second end of the door is swung away from the second stile; and a first member extending across the first seam when the door is in the closed position to block viewing through the seam, wherein the first member extends from one of said door and said first stile, wherein the first member is received in a channel formed on the other of said door and said first stile when the door is in the closed position and is withdrawn from said channel when the door is in the open position, wherein the channel has a channel-shaped cross-section defined along a plane perpendicular to said generally longitudinal axis, and wherein the channel is formed on an end of said other of said door and said first stile and extends within said other of said door and said first stile.

2. The system as recited in claim 1, wherein the first member is mounted to one of said door and said first stile.

3. The system as recited in claim 1, further comprising a channel shaped member complementary to said channel and fitted into said channel, wherein said first member is received in said channel shaped member.

4. The system as recited in claim 3, comprising an angle, wherein said first member is a first flange of said angle which extends transversely from a second flange of said angle.

5. The system as recited in claim 1, further comprising a second member extending across the second seam when the door is in the closed position.

6. The system as recited in claim 5, wherein the second member is mounted to one of the door and the second stile.

7. A method of installing a partition system comprising:

coupling a first stile bracket vertically to a first side wall;

determining if said coupled first stile bracket is vertically plumb;

coupling a first stile having a first end opposite a second end to the first stile bracket with the second end distal from said stile bracket and wherein during coupling of said first stile to said first stile bracket, said method comprises aligning said first stile relative to said first stile bracket such that the second end is vertically plumb when said first stile bracket is not vertically plumb;

coupling a first panel bracket vertically to a rear wall, said rear wall extending transversely from the first side wall;

coupling a first side panel having a first end opposite a second end to said first panel bracket, wherein the first side panel second end is distal from said first panel bracket and wherein said first side panel second end is vertically plumb;

connecting a second stile to the first side panel after said coupling the first side panel, wherein the first side panel extends from the second stile to the first panel bracket; and rotatably coupling a first door comprising a first end opposite a second end to the first stile, wherein the door is rotatable between the first and second stiles between a closed position where the first end of the door is adjacent the first stile defining a first seam there-between and the second end of the door is adjacent the second stile defining a second seam there-between, and an open position where the second end of the door is swung away from the second stile.

8. The method of claim 7, further comprising:

coupling a second panel bracket vertically to a rear wall spaced apart from the first panel bracket;

determining if the coupled second panel bracket is vertically plumb;

coupling a second side panel having a first end opposite a second end to said second panel bracket, wherein the second end of said second side panel is distal from said second panel bracket and wherein said second side panel is aligned relative to the second panel bracket such that its second end is vertically plumb when said second panel bracket is not vertically plumb;

connecting a third stile to the second side panel after said coupling the second side panel, wherein the second side panel extends from the third stile to the second panel bracket; and rotatably coupling a second door comprising a first end opposite a second end to the second stile, wherein the second door is rotatable between the second and third stiles between a closed position where the first end of the second door is adjacent the second stile defining a third seam there-between and the second end of the second door is adjacent the third stile defining a fourth seam there-between, and an open position where the second end of the second door is swung away from the third stile.

9. The method of claim 8, further comprising coupling a head rail to said first and second side panels.

10. The method of claim 8, wherein coupling the first stile to the first stile bracket comprises coupling the first stile to the first stile bracket with the first end of the first stile extending at an angle relative to the first side wall along a plane of said first stile, said plane extending through the entire first stile.

11. The method of claim 8, wherein coupling the first side panel to the first side panel bracket comprises coupling the first side panel to the first side panel bracket with the first end of the first side panel extending at an angle relative to the rear wall along a plane of said first side panel, said plane extending through the entire first side panel.

12. The method of claim 8, wherein coupling the second side panel to the second side panel bracket comprises coupling the second side panel to the second side panel bracket with the first end of the second side panel extending at an angle relative to the rear wall along a plane of said second side panel, said plane extending through the entire second side panel.

13. The method of claim 7, further comprising:

coupling one or more second panel brackets vertically to a rear wall spaced apart from the first panel bracket;

determining if each of said coupled one or more second panel brackets is vertically plumb;

coupling one or more second side panels, each of said one or more second side panels having a first end opposite a second end, to said one or more second panel brackets, wherein each of said one or more second side panels is coupled to a corresponding second panel bracket of said one or more second panel brackets, wherein the second end of each of said one or more second side panels is distal from its corresponding second panel bracket and wherein said each of said one or more second side panel is aligned relative to its corresponding second panel bracket such that its second end is vertically plumb when its corresponding second panel bracket is not vertically plumb;

connecting one or more third stiles to the one or more second side panels after said coupling said one or more second side panels, wherein the one or more second side panels each extend from their corresponding third stile to their corresponding second panel bracket; and rotatably coupling at least one or more second doors comprising a first end opposite a second end to the one or more second stiles, wherein each of the one or more second doors is rotatable between its corresponding second and third stiles between a closed position where the first end of each of the one or more second doors is adjacent its corresponding second stile defining a seam there-between and the second end of each of the one or more second doors is adjacent its corresponding third stile defining another seam there-between, and an open position where the second end of each of the one or more second doors is swung away from its corresponding third stile.

14. The method of claim 13, further comprising:

coupling a second stile bracket to a second side wall spaced apart from the first side wall, wherein said rear wall extends between the first and second side walls;

coupling a fourth stile having a first end opposite a second end to the second stile bracket with the first end of the fourth stile distal from said stile bracket and wherein the first end is vertically plumb.

15. The method of claim 14, further comprising:

rotatably coupling another door comprising a first end opposite a second end to a last stile of said one or more third stiles, wherein said another door is rotatable between the last stile and fourth stile between a closed position where the first end of said another door is adjacent the last stile defining a seam there-between and the second end of said another door is adjacent the fourth stile defining a seam there-between, to an open position where the second end of said another door is swung away from the fourth stile.

16. The method of claim 15, wherein the first side of a second side panel of said one or more second side panels is at an angle relative to the rear wall along a plane of said second side panel, said plane extending through said entire second panel.

17. The method of claim 15, further comprising coupling a head rail to said first and said one or more second side panels.

18. The method of claim 7, further comprising mounting a pedestal on a floor and coupling said first side panel to the pedestal.

19. The method of claim 7, wherein said first panel bracket is channel shaped in cross-section, and wherein coupling said first side panel comprises placing an end portion of said first side panel in said channel shaped first panel bracket.

20. The method of claim 8, wherein said second panel bracket is channel shaped in cross-section, and wherein coupling said one or more second side panel comprises placing an end portion of said second side panel in said channel shaped second panel bracket.

21. The method of claim 13, wherein said one or more second panel brackets is channel shaped in cross-section, and wherein coupling said one or more second side panels comprises placing an end portion of said one or more second side panels in said channel shaped one or more second panel brackets.

22. The method of claim 7, wherein after coupling the first stile bracket to the first side wall, the first stile bracket is not vertically plumb.

* * * * *